US010586476B1

(12) United States Patent
Vescovi

(10) Patent No.: US 10,586,476 B1
(45) Date of Patent: Mar. 10, 2020

(54) ARTISTIC TILES MOUNTABLE TO A SURFACE

(71) Applicant: Carlo Vescovi, Lake Forest, CA (US)

(72) Inventor: Carlo Vescovi, Lake Forest, CA (US)

( * ) Notice: Subject to any disclaimer, the term of this patent is extended or adjusted under 35 U.S.C. 154(b) by 0 days.

(21) Appl. No.: 16/400,794

(22) Filed: May 1, 2019

Related U.S. Application Data

(60) Provisional application No. 62/802,175, filed on Feb. 6, 2019, provisional application No. 62/818,008, filed on Mar. 13, 2019.

(51) Int. Cl.
*G09F 15/00* (2006.01)

(52) U.S. Cl.
CPC ..... *G09F 15/0018* (2013.01)

(58) Field of Classification Search
CPC ... G09F 15/0018; A63H 33/04; A63H 33/046; A63H 33/26; A63H 18/10; A63H 33/00; A63H 13/00; A63F 9/34
USPC ..... 446/92, 129, 137, 139, 134
See application file for complete search history.

(56) References Cited

U.S. PATENT DOCUMENTS

| | | | | |
|---|---|---|---|---|
| 2,737,742 | A | 3/1956 | Leigh | |
| 3,254,440 | A * | 6/1966 | Duggar | A63H 33/046 446/92 |
| 3,286,387 | A | 11/1966 | Poertner | |
| 5,359,794 | A | 11/1994 | Wood | |
| 6,116,979 | A * | 9/2000 | Weber | A63F 9/1208 273/157 R |
| 6,684,546 | B1 | 2/2004 | Chang | |
| 8,573,471 | B2 | 11/2013 | Wong | |
| 8,966,796 | B2 | 3/2015 | Ridless | |
| 9,402,488 | B2 | 8/2016 | Morrish | |
| 9,706,861 | B2 | 7/2017 | Wong | |
| 2005/0193613 | A1 | 9/2005 | Faltesek | |
| 2014/0357151 | A1 * | 12/2014 | Worley | A63H 33/046 446/92 |
| 2017/0084208 | A1 | 3/2017 | Durant | |

FOREIGN PATENT DOCUMENTS

| | | | |
|---|---|---|---|
| JP | 2017144562 | A | 8/2017 |
| KR | 200274366 | Y1 | 4/2002 |

OTHER PUBLICATIONS

All Packaging Company, "Folding Carton Structures Defined," 5 pages [online], retrieved from the Internet on Jan. 7, 2019. Retrieved from <URL:http://www.allpack.com/StructuresDefined.php>.

(Continued)

*Primary Examiner* — Cassandra Davis
(74) *Attorney, Agent, or Firm* — Klein, O'Neill & Singh, LLP

(57) ABSTRACT

A system for attaching a plurality of folding cartons having images printed thereon is disclosed. An anchor folding carton may be secured to a wall and all other adjacent folding cartons may be secured to the anchor folding carton. In particular, the folding cartons may be attached to each other with magnets. Also, the top and bottom flaps and side panels may have angled reliefs that allow the adjacent folding cartons to lay flat on the wall regardless of deformations (e.g. curvature) of the paper used to make the folding carton.

15 Claims, 35 Drawing Sheets

(56) References Cited

OTHER PUBLICATIONS

Artsy Couture, "Artsy Couture Canvas Click Frame," 5 pages [online], retrieved from the Internet on Aug. 5, 2019. Retrieved from <URL:https://www.youtube.com/watch?v=p3V8ttLa614&>.
Bert Co, "Folding Carton Styles—6 Basic Cartons," 1 page [online], retrieved from the Internet on Jan. 7, 2019. Retrieved from <URL:http://www.bertco.com/>.
CCL Healthcare, "The Folding Carton Specialists," Jan. 2019, 33 pages.
Sierra packaging, "Folding Carton 101," 3 pages [online], retrieved from the Internet on Jan. 7, 2019. Retrieved from <URL:http://www.sierrapack.com/folding-carton-101/>.
The New York Label & Box Works, "Folding Carton Styles," 13 pages [online], retrieved from the Internet on Jan. 7, 2019. Retrieved from <URL:http://www.since1878.com/index.php>.

* cited by examiner

ARTISTIC TILES MOUNTABLE TO A SURFACE

CROSS-REFERENCE TO RELATED APPLICATIONS

This application claims the benefits of U.S. Ser. No. 62/802,175, filed on Feb. 6, 2019 and U.S. Ser. No. 62/818,008, filed on Mar. 13, 2019, the entire contents of which is expressly incorporated herein by reference.

STATEMENT RE: FEDERALLY SPONSORED RESEARCH/DEVELOPMENT

Not Applicable

BACKGROUND

The various aspects and embodiments described herein relate to a plurality of folding cartons wherein an image is printed on an exterior side and the plurality of folding cartons may be mounted on a wall in an aesthetically pleasing manner.

Various types of pictures can be hung on a wall. Moreover, collages or multiple frames can be hung next to each other. However, this requires painstaking attention to detail to level all of the pictures to each other so that the pictures do not appear crooked.

There is a need in the art for an improved system for mounting a plurality of pictures on a wall.

BRIEF SUMMARY

The various embodiments and aspects therein relate to the issues discussed above, discussed below and those that are known in the art.

A plurality of folding cartons may be fabricated so as to be mounted to a wall. One of the folding cartons or tiles (e.g., anchor tile or folding carton) may be mounted to the wall directly. All of the other remaining folding cartons or tiles may be indirectly secured to the wall by being secured or attached to the anchor folding carton or tile. The folding cartons may have magnets that are used to attract and secure adjacent folding cartons to the wall and to each other. A relief angle may be formed in the top and bottom flaps and the side panels of the folding cartons so that any outward bowing or deformation in the top and bottom flaps and the side panels do not cause the adjacent tiles and folding cartons to lift off of the wall.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
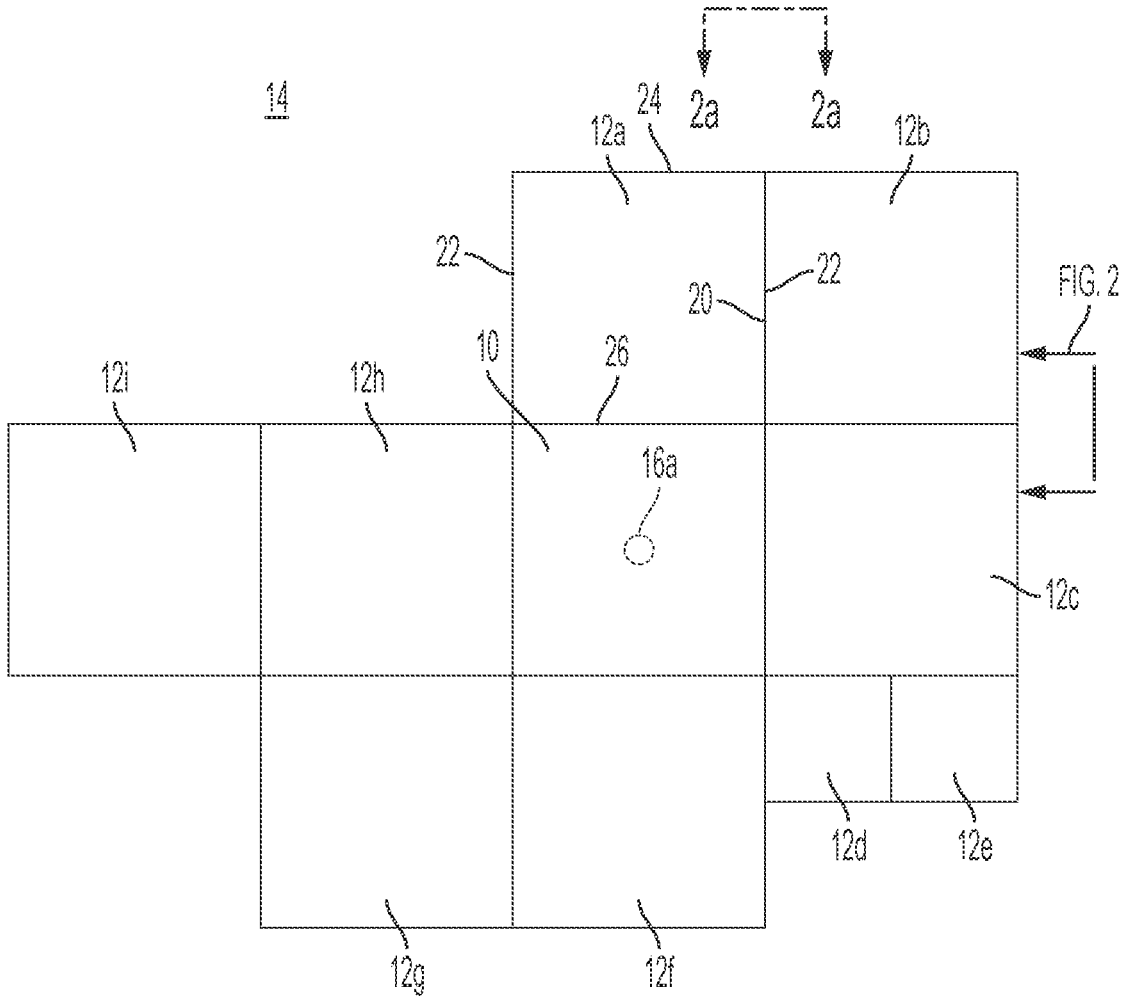
FIG. 1 is a front view of a plurality of tiles or folding cartons mounted to a wall.
Figure 13:
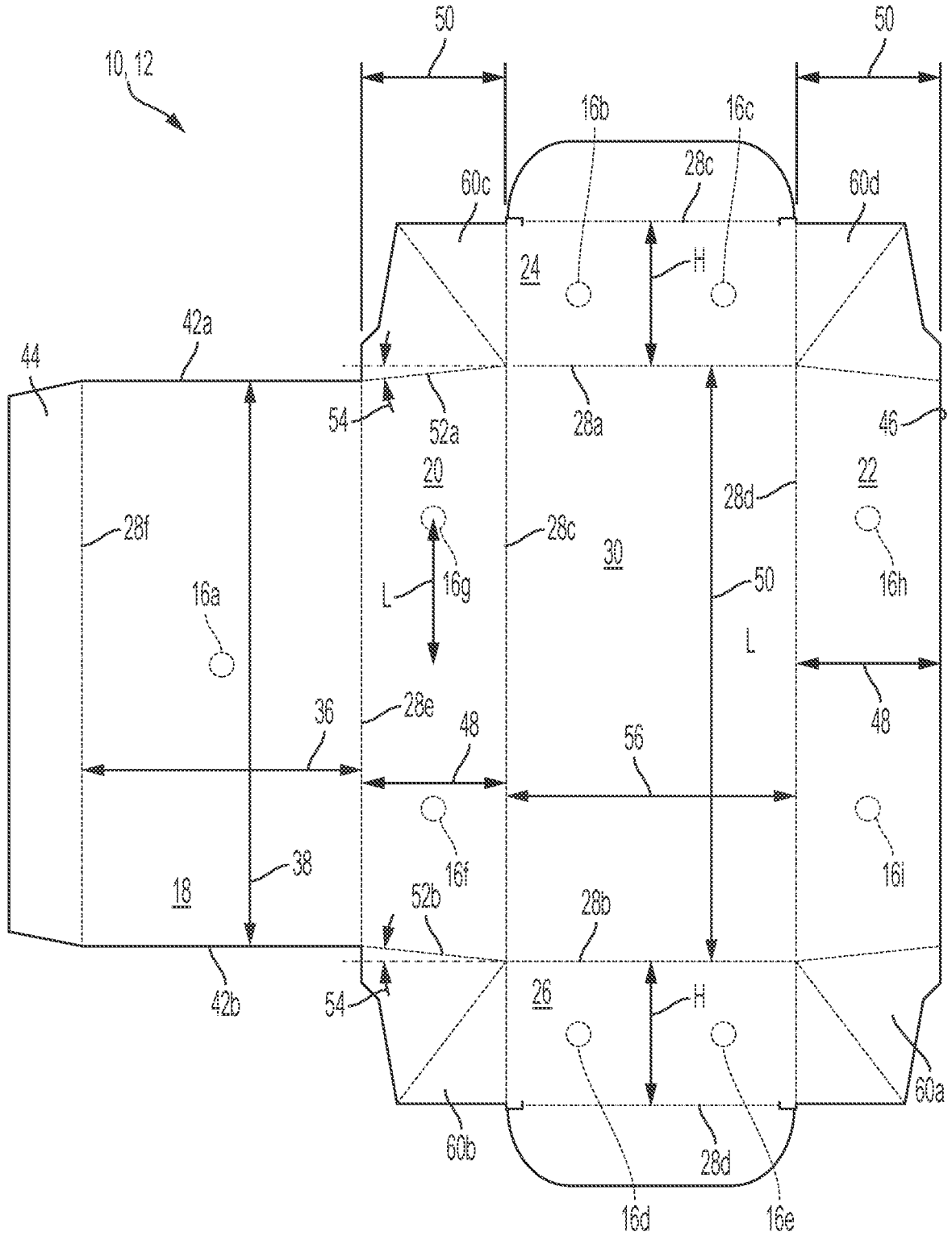
FIG. 13 illustrates an interior view of the folding carton shown in FIG. 12 prior to folding and gluing.
Figure 14:
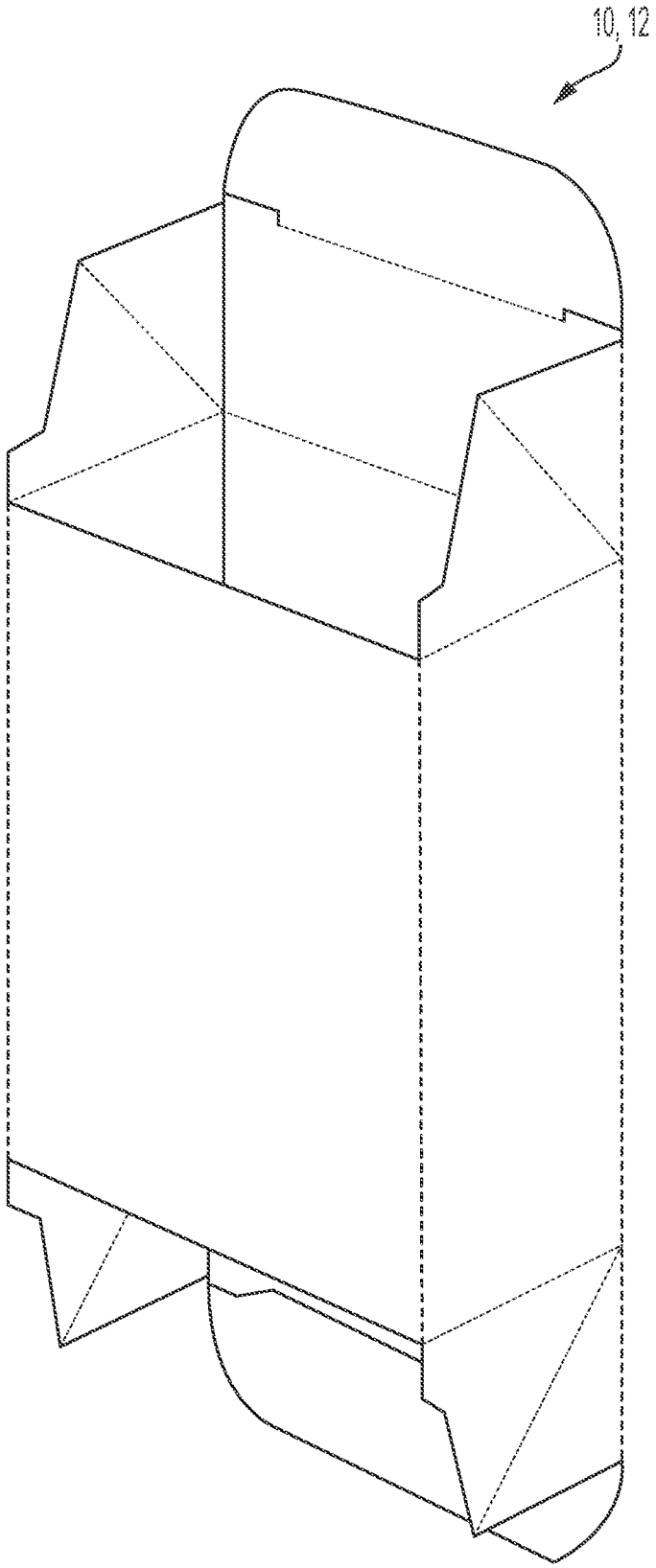
FIG. 14 illustrates a second folding carton style of the tile.
Figure 15:
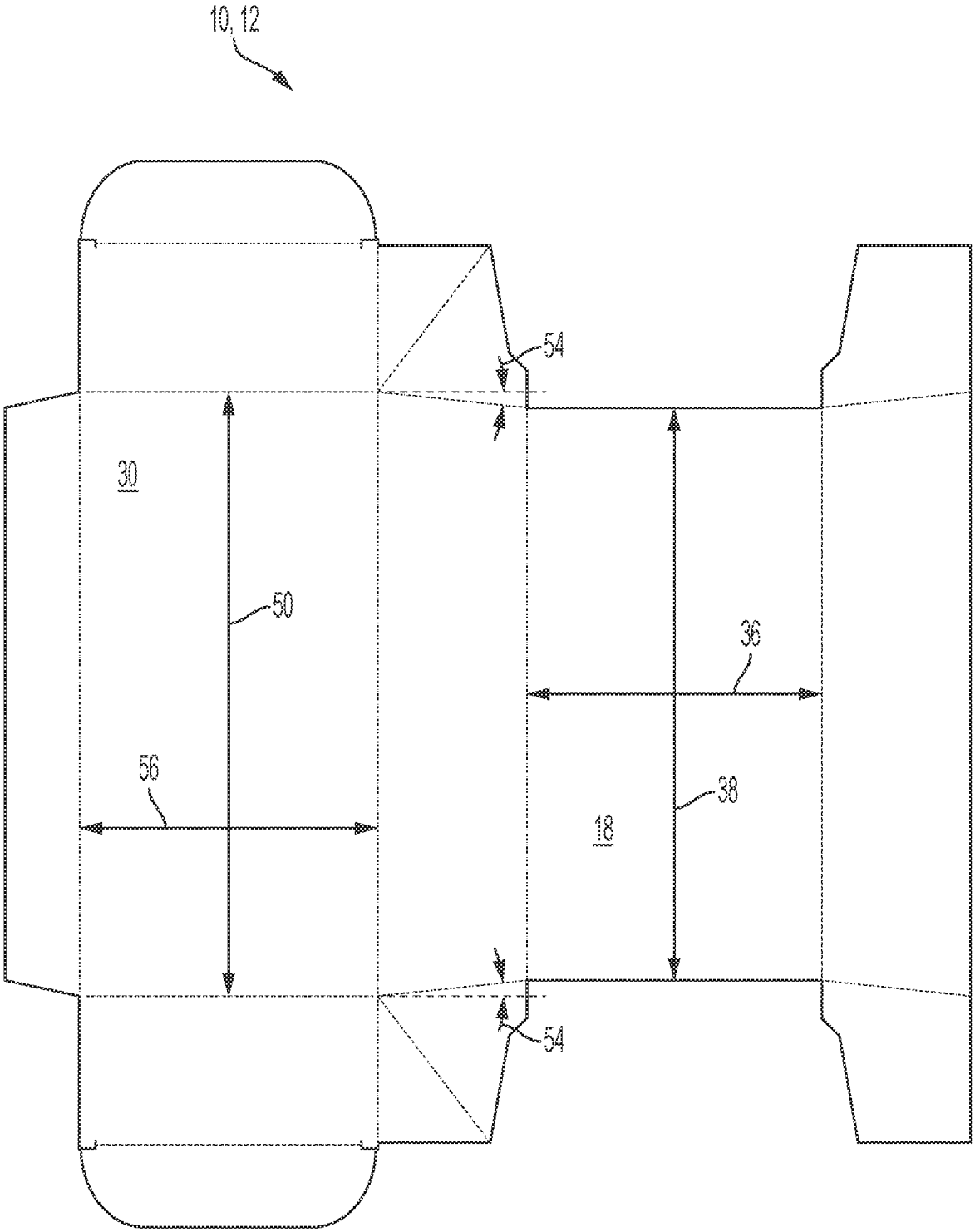
FIG. 15 illustrates an interior view of the folding carton shown in FIG. 14 prior to folding and gluing.
Figure 16:
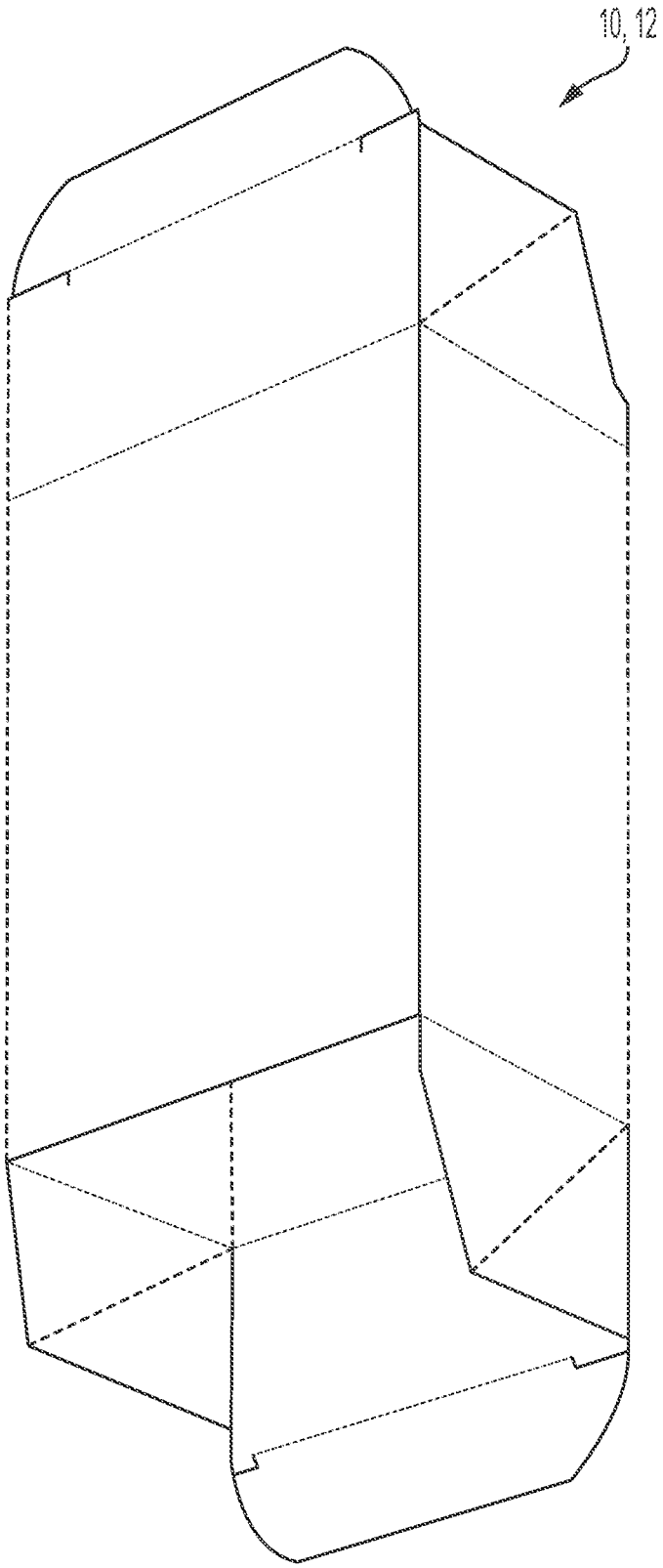
FIG. 16 illustrates a third folding carton style of the tile.
Figure 17:
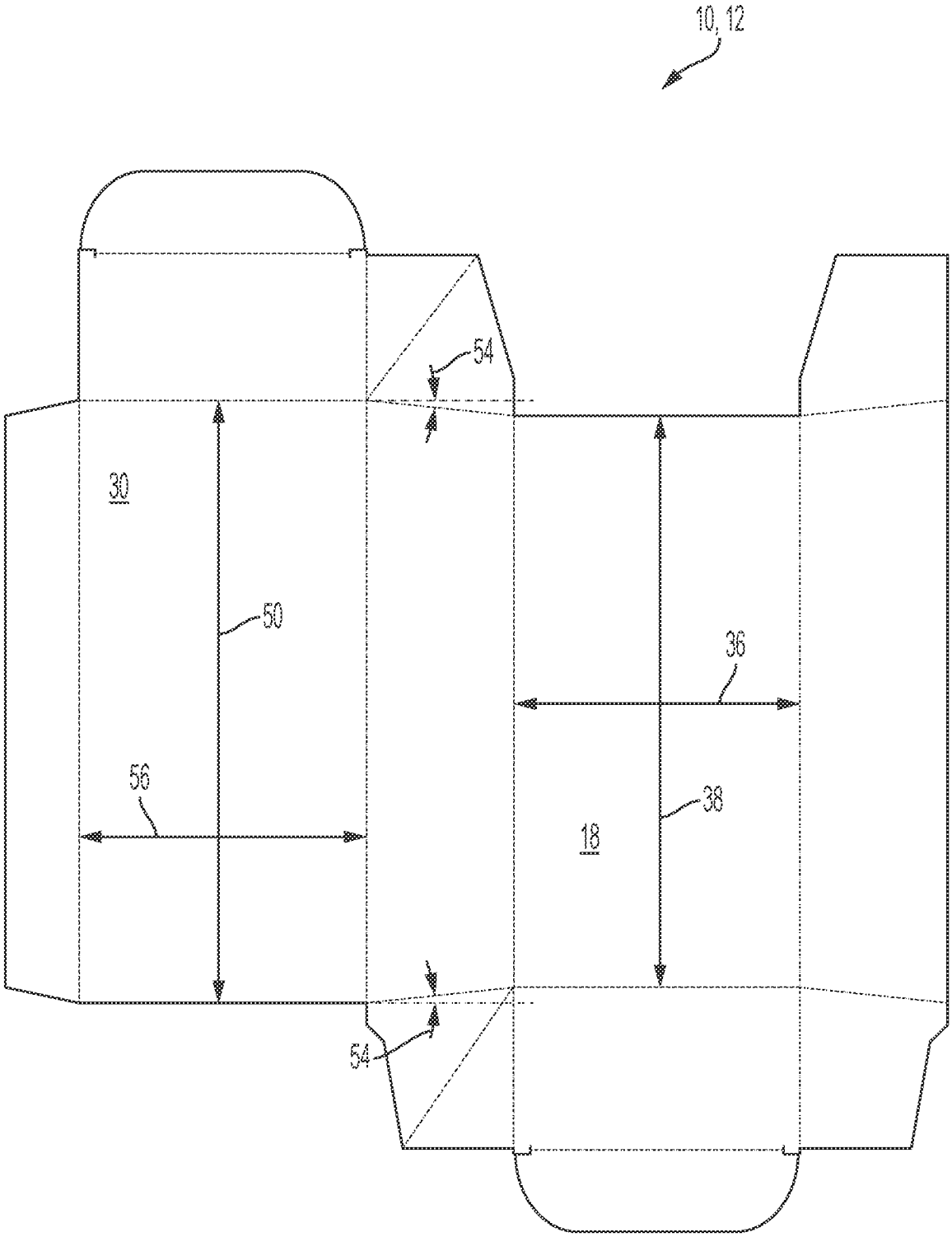
FIG. 17 illustrates an interior view of the folding carton shown in FIG. 16 prior to folding and gluing.
Figure 18:
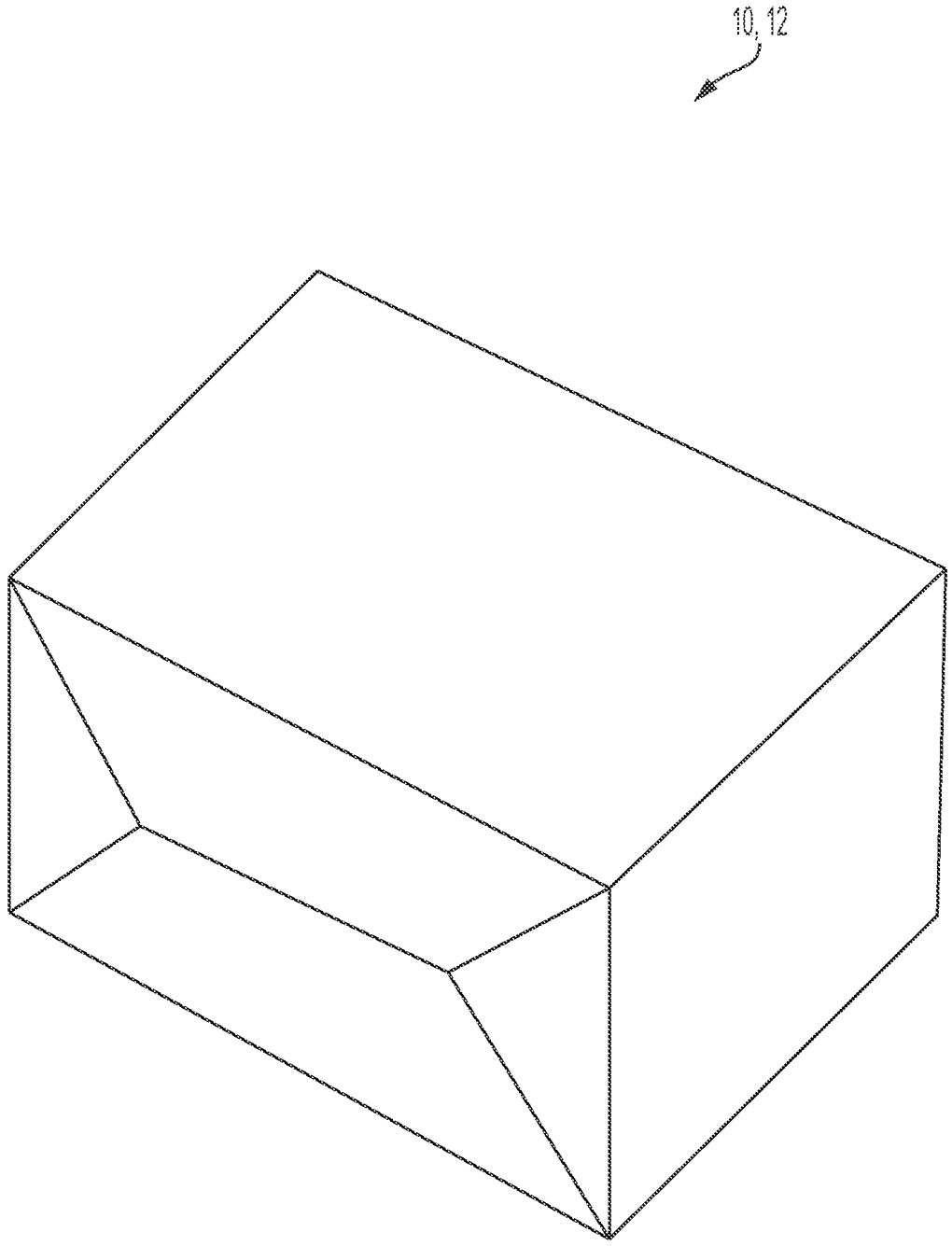
FIG. 18 illustrates a fourth folding carton style of the tile.
Figure 19:
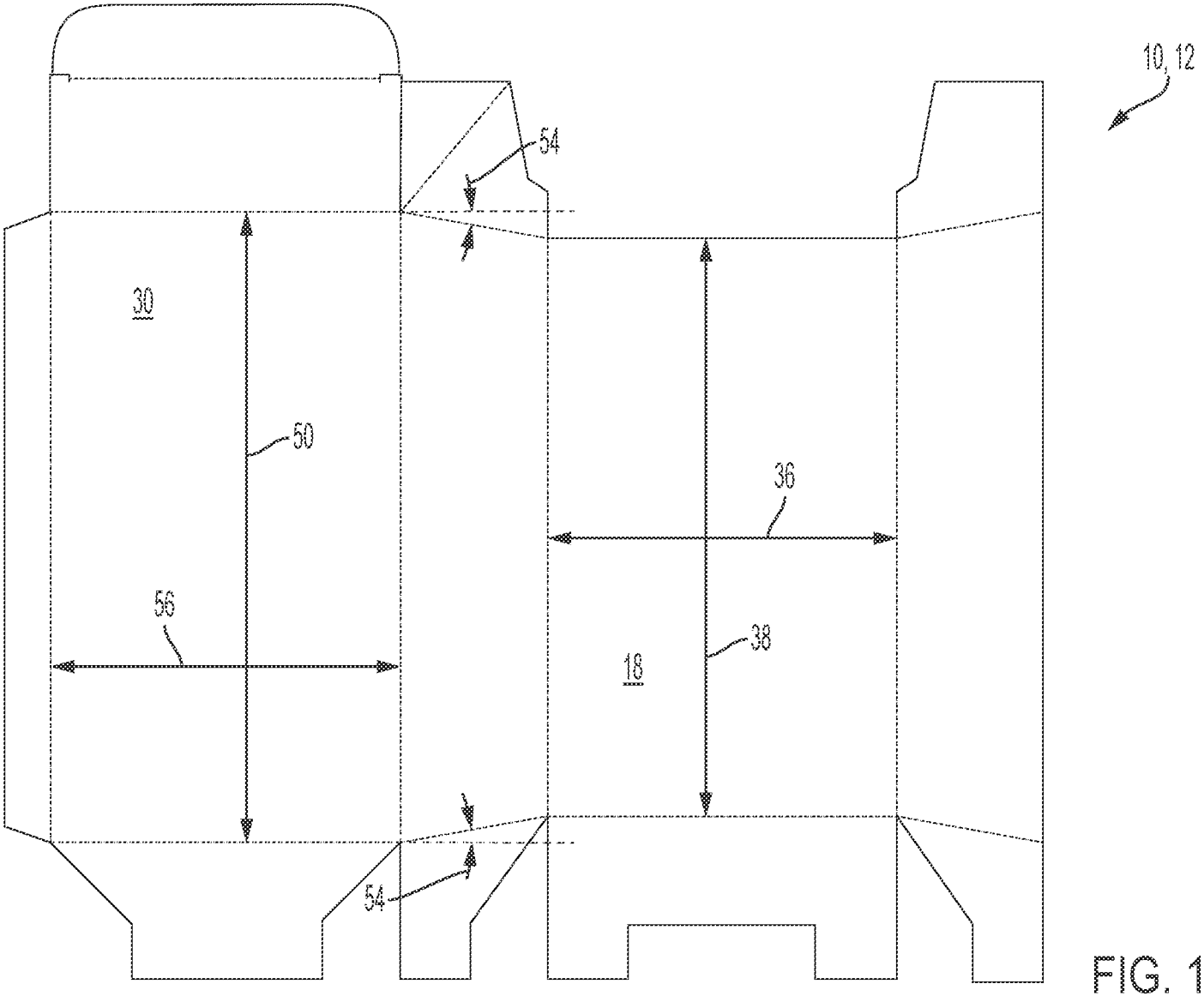
FIG. 19 illustrates an interior view of the folding carton shown in FIG. 18 prior to folding and gluing.
Figure 20:
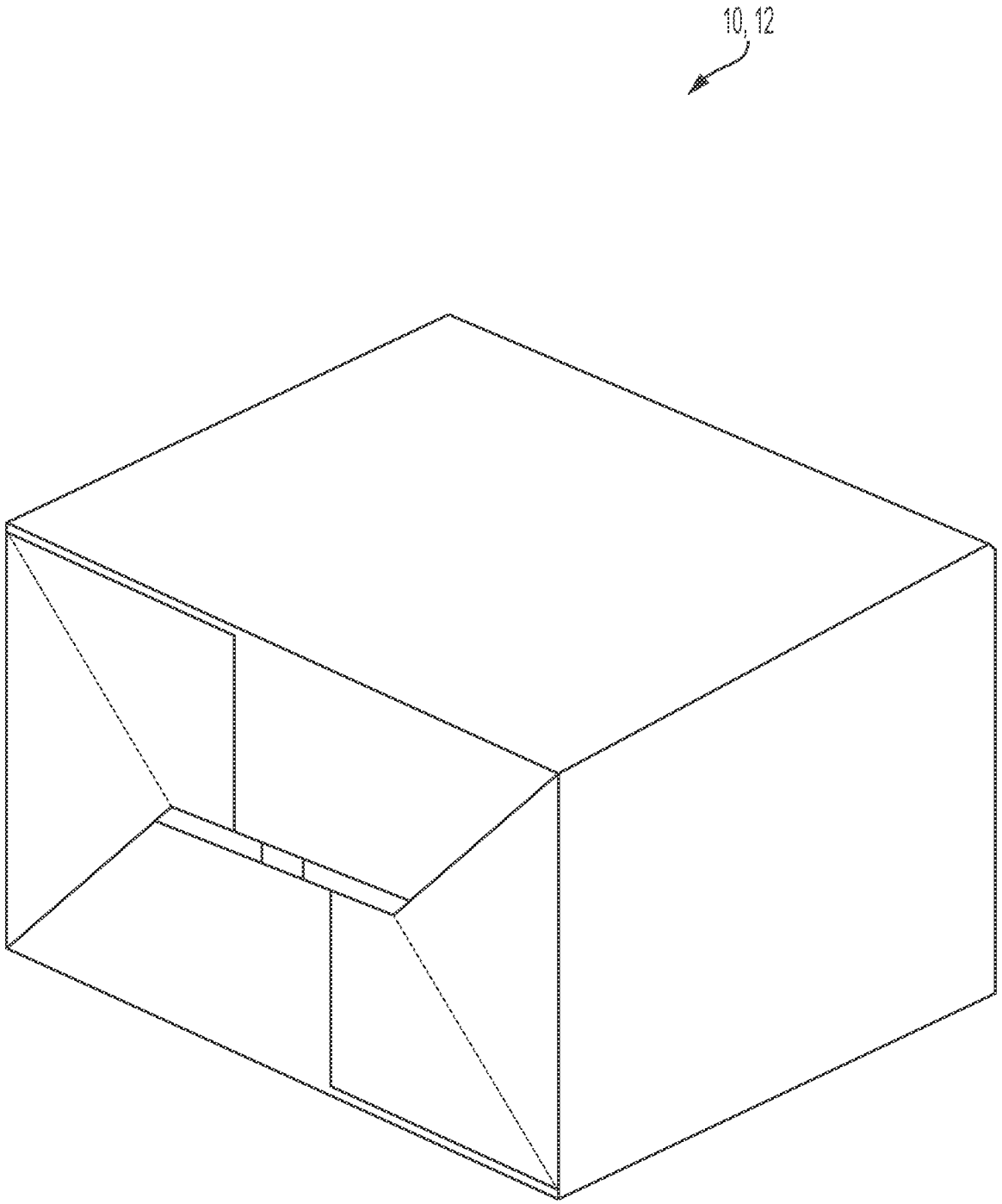
FIG. 20 illustrates a fifth folding carton style of the tile.
Figure 21:
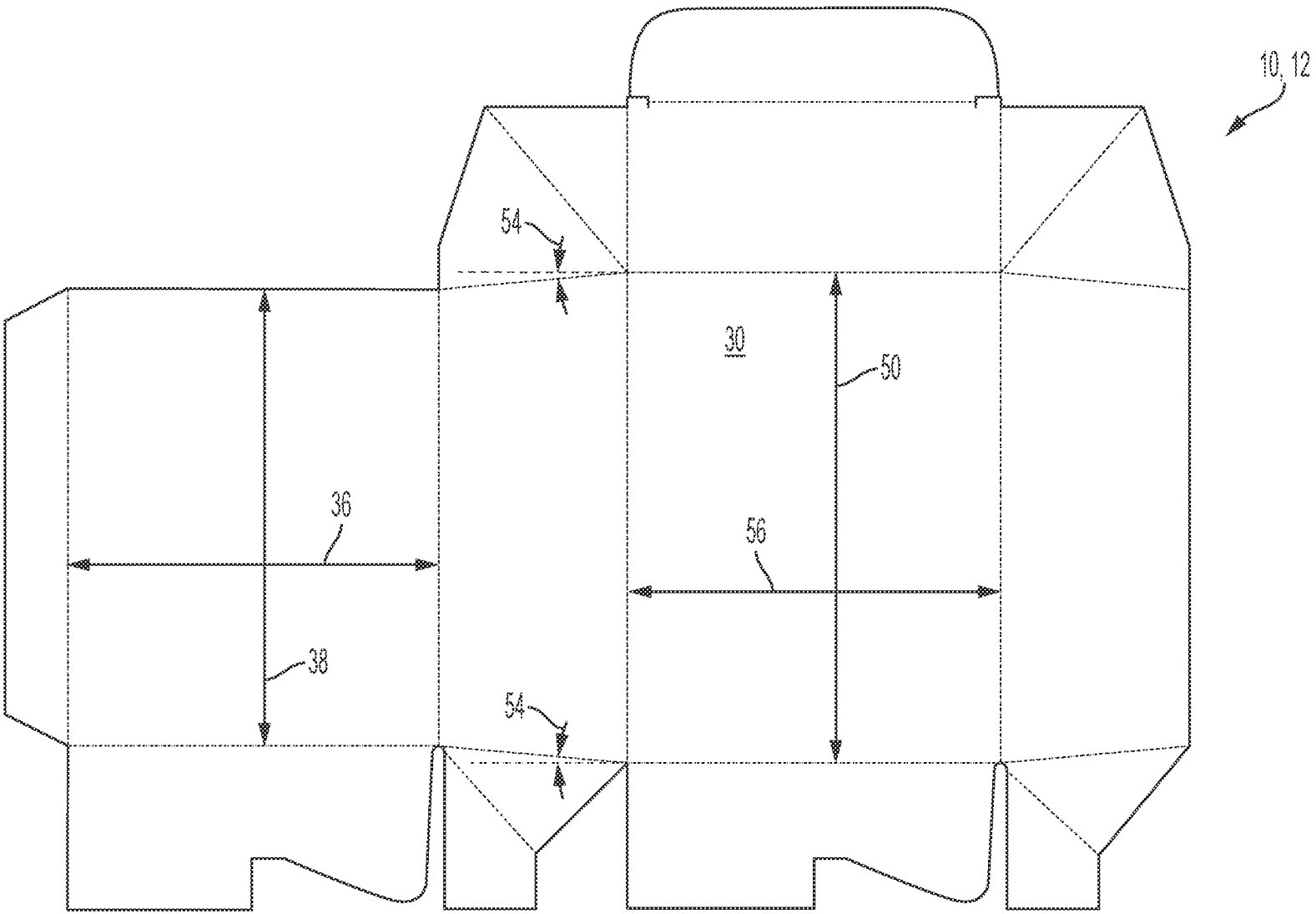
FIG. 21 illustrates an interior view of the folding carton shown in FIG. 20 prior to folding and gluing.
Figure 22:
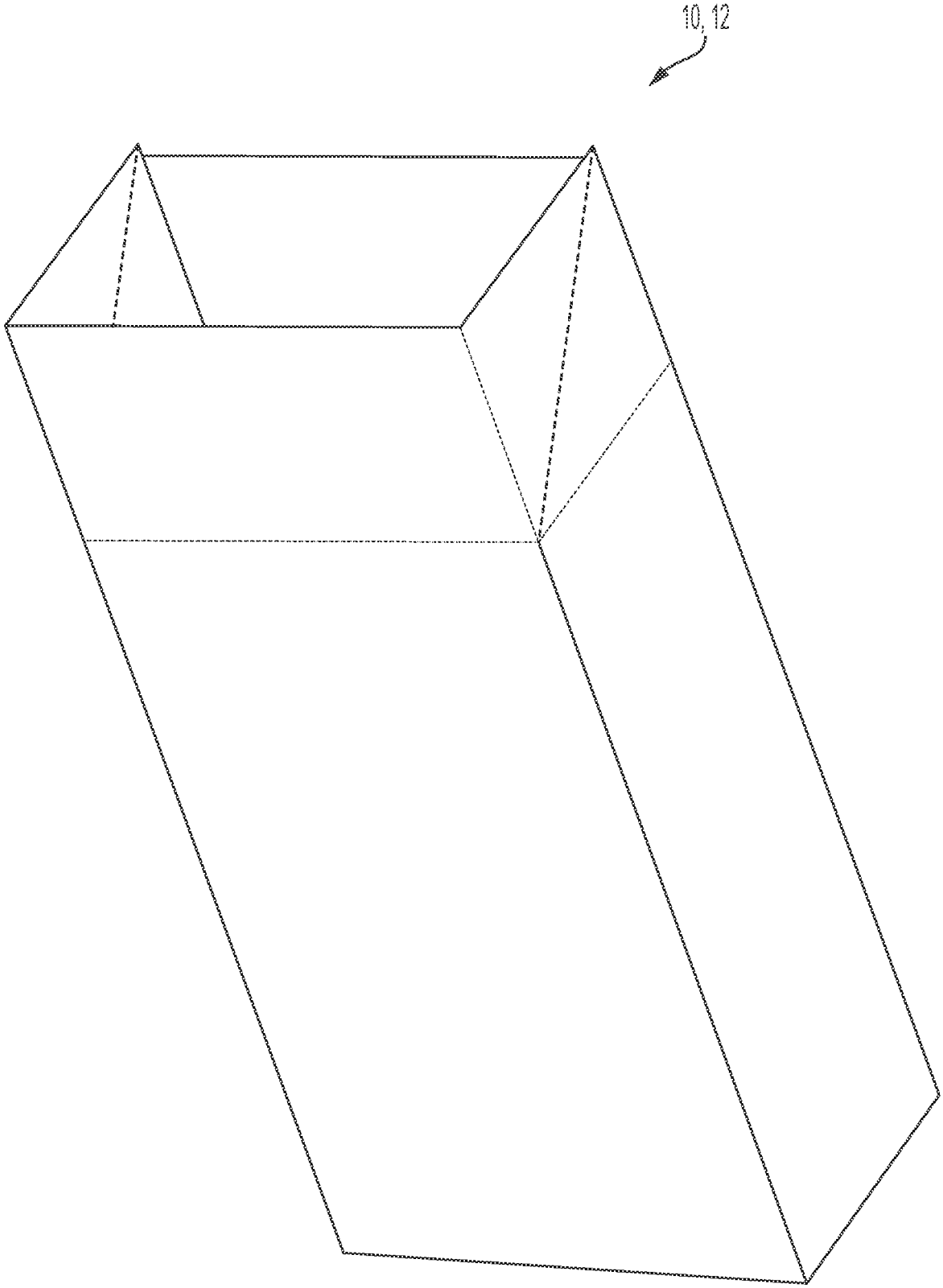
FIG. 22 illustrates a sixth folding carton style of the tile.
Figure 23:
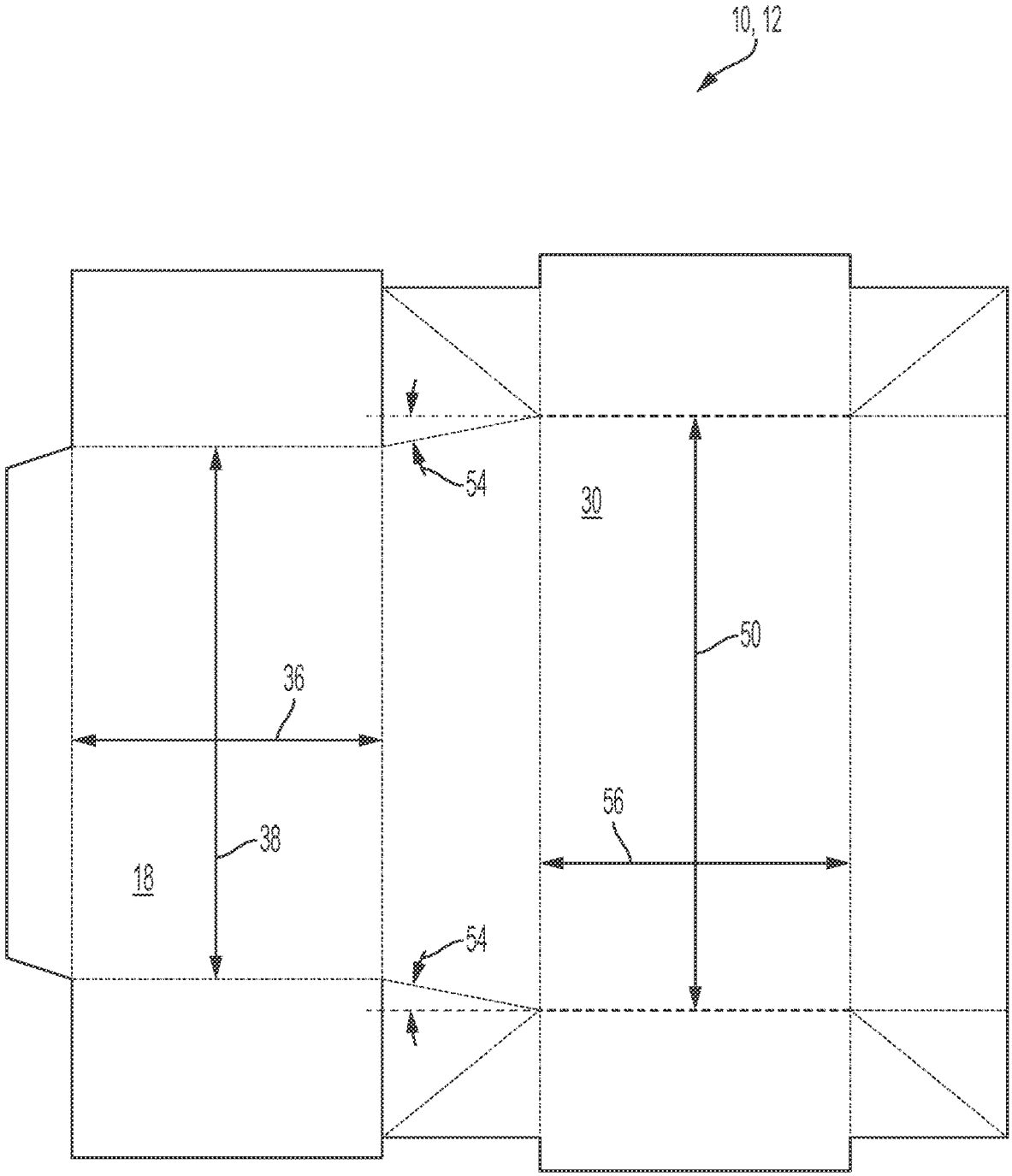
FIG. 23 illustrates an interior view of the folding carton shown in FIG. 22 prior to folding and gluing.
Figure 24:
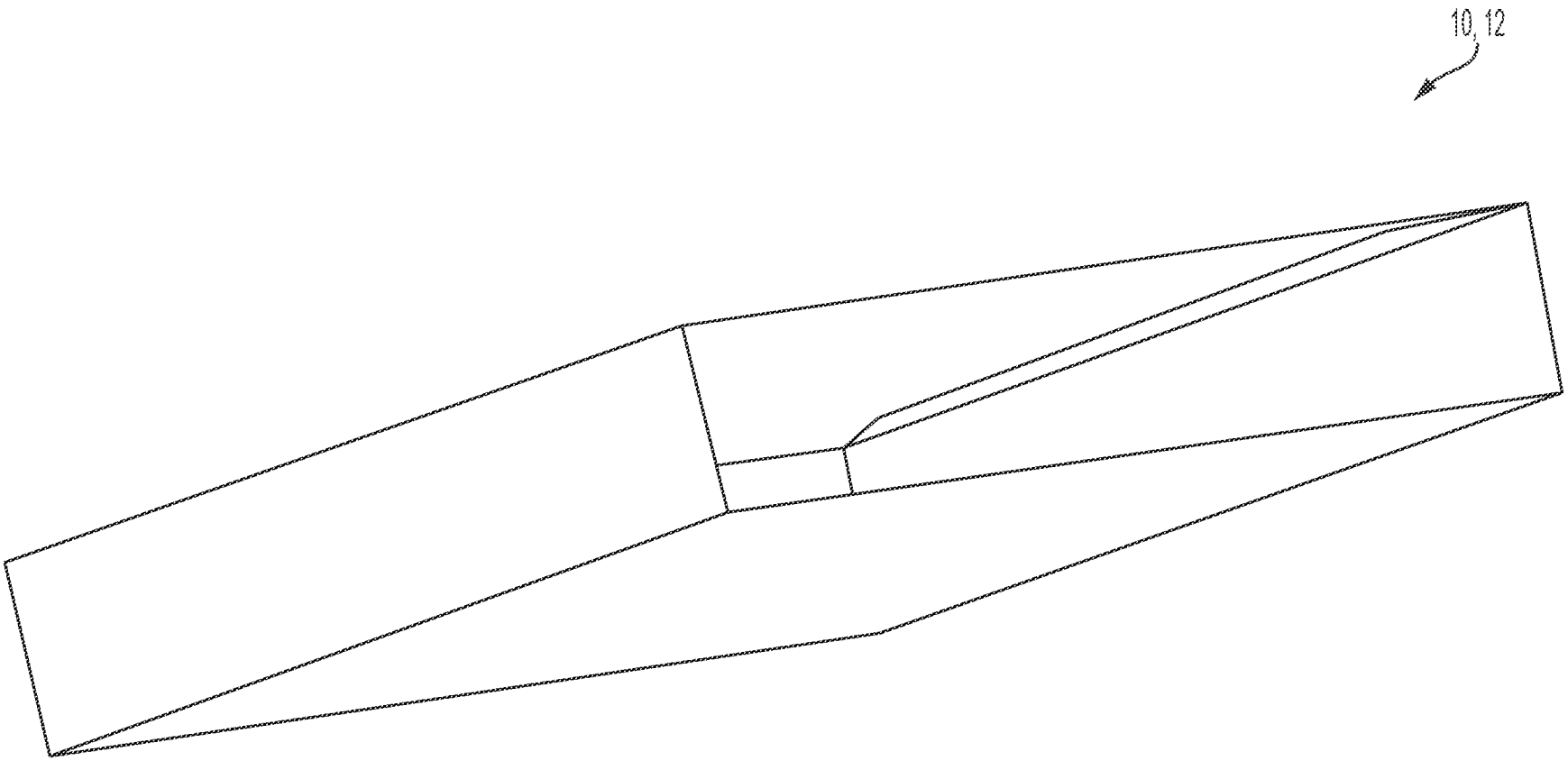
FIG. 24 illustrates a seventh folding carton style of the tile.
Figure 25:
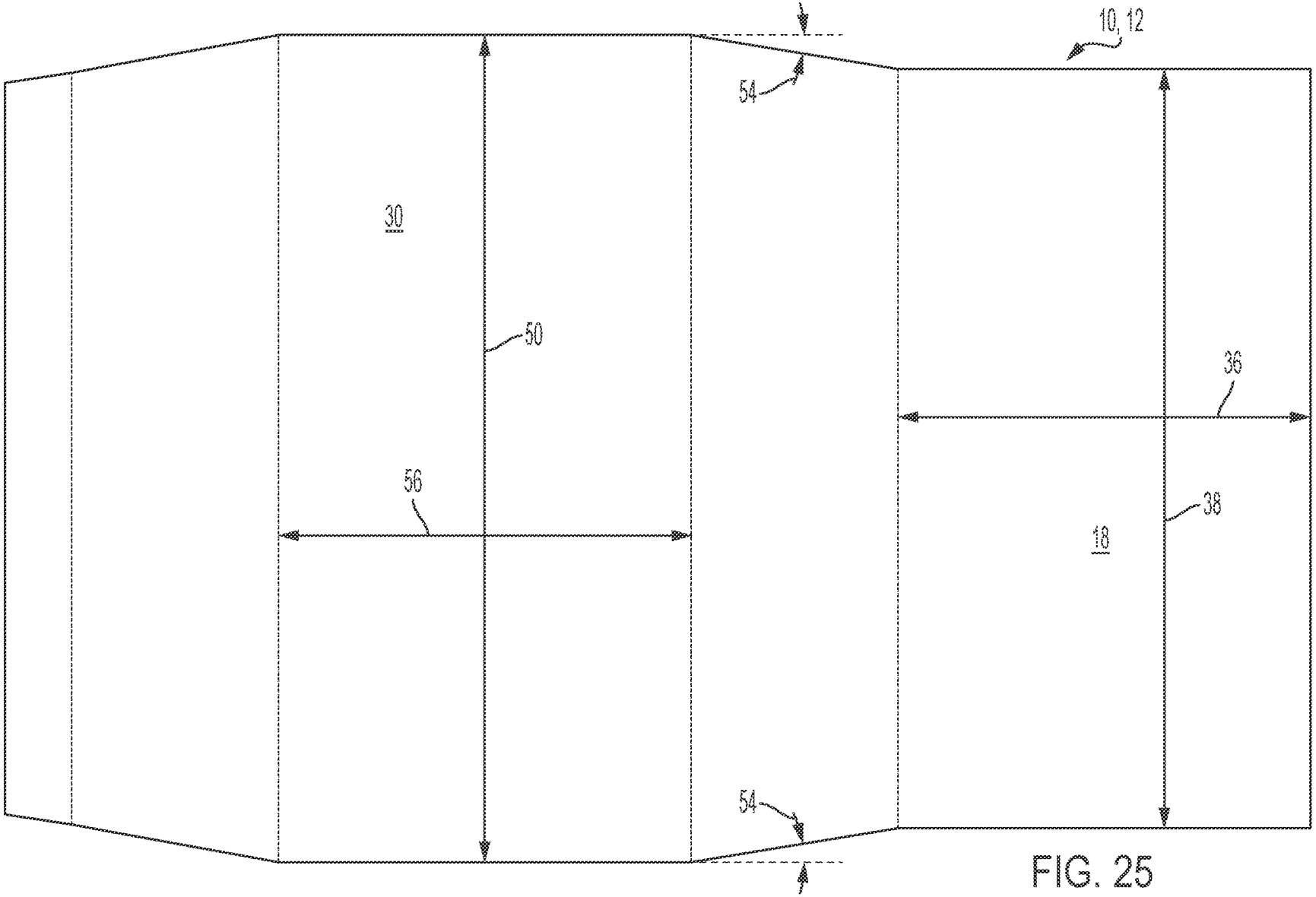
FIG. 25 illustrates an interior view of the folding carton shown in FIG. 24 prior to folding and gluing.

Referring now to FIG. 1, a plurality of folding cartons (i.e. tiles) 10, 12*a-i* is shown which is mounted to a wall 14. Tile 10 (i.e., anchor tile) may be directly secured to the wall 14 and the remaining tiles 12*a-i* may only appear to be directly attached to the wall 14 but may be directly attached to the tile 10 or an adjacent tile 12. The tiles 12*a-i* may be indirectly attached to the wall. For example, tile 12*i* is indirectly attached to tile 10 by tile 12*h*. More particularly, tile 10 may have a magnet 16*a* (FIGS. 1, 11A and 13) attached to an interior side of a rear panel 18 (see FIG. 13). When the folding carton 10 (i.e., tile 10) shown in FIG. 13 is folded and glued and assembled, the magnet 16*a* may be used to secure the tile 10 to a metallic wall or a wall to which the magnet 16*a* is attached to. The side panels 20, 22 and the top and bottom flaps 24, 26 of tile 10 may also have magnets 16*b-i* (see FIG. 13). The tile 10 may incorporate magnet 16*a-i*. Tiles 12 may incorporate magnet 16*b-i*. In this regard, the tiles 12 may be attached to adjacent tiles 12 or the tile 10 through the attractive forces of the magnets 16*b-i* which may be attached to the side panels 22, 24 and the top and bottom flaps 24, 26.

Figure 2:
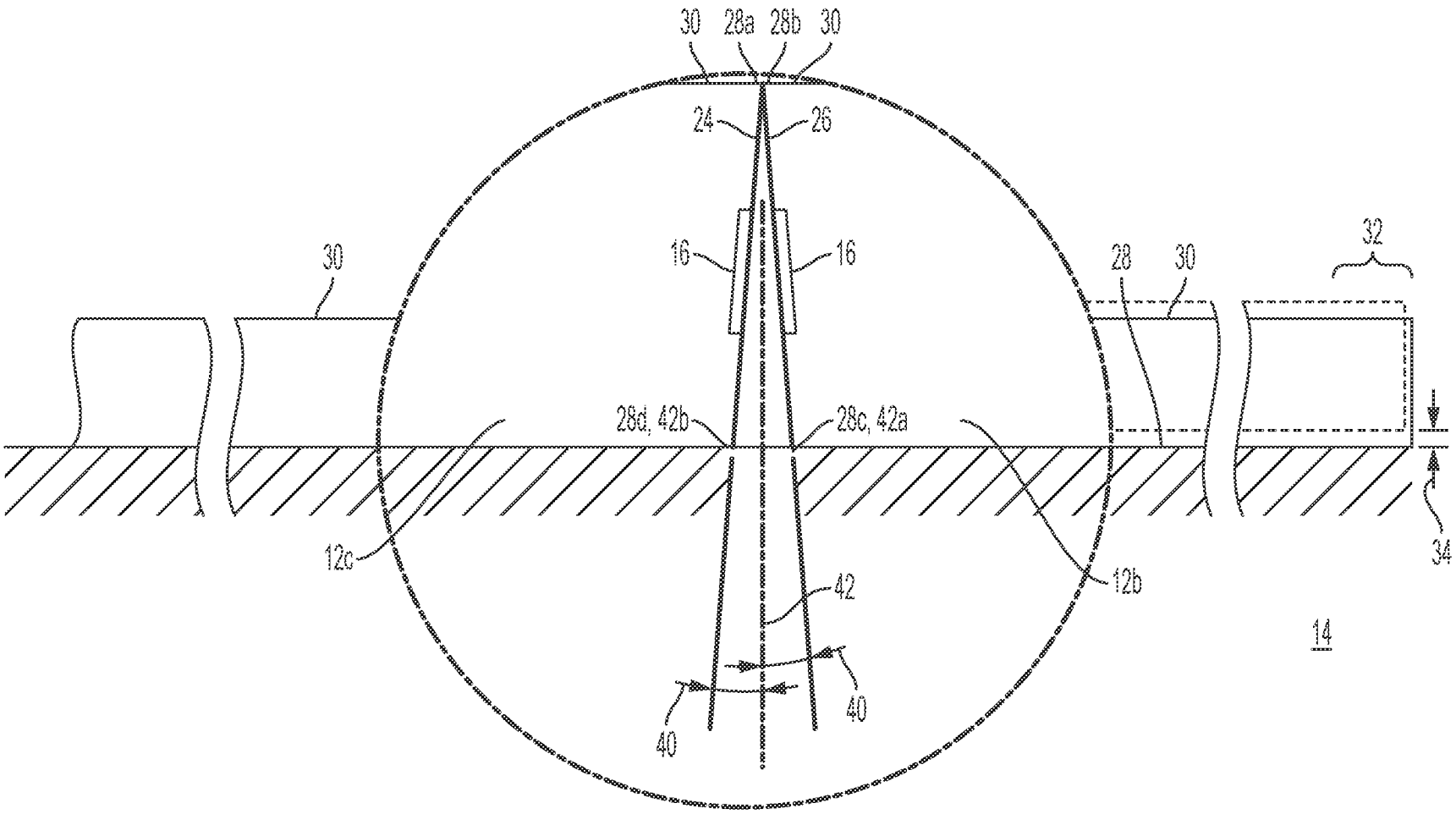
FIG. 2 is a side view of two adjacent tiles/folding cartons one above the other.
Figure 2A:
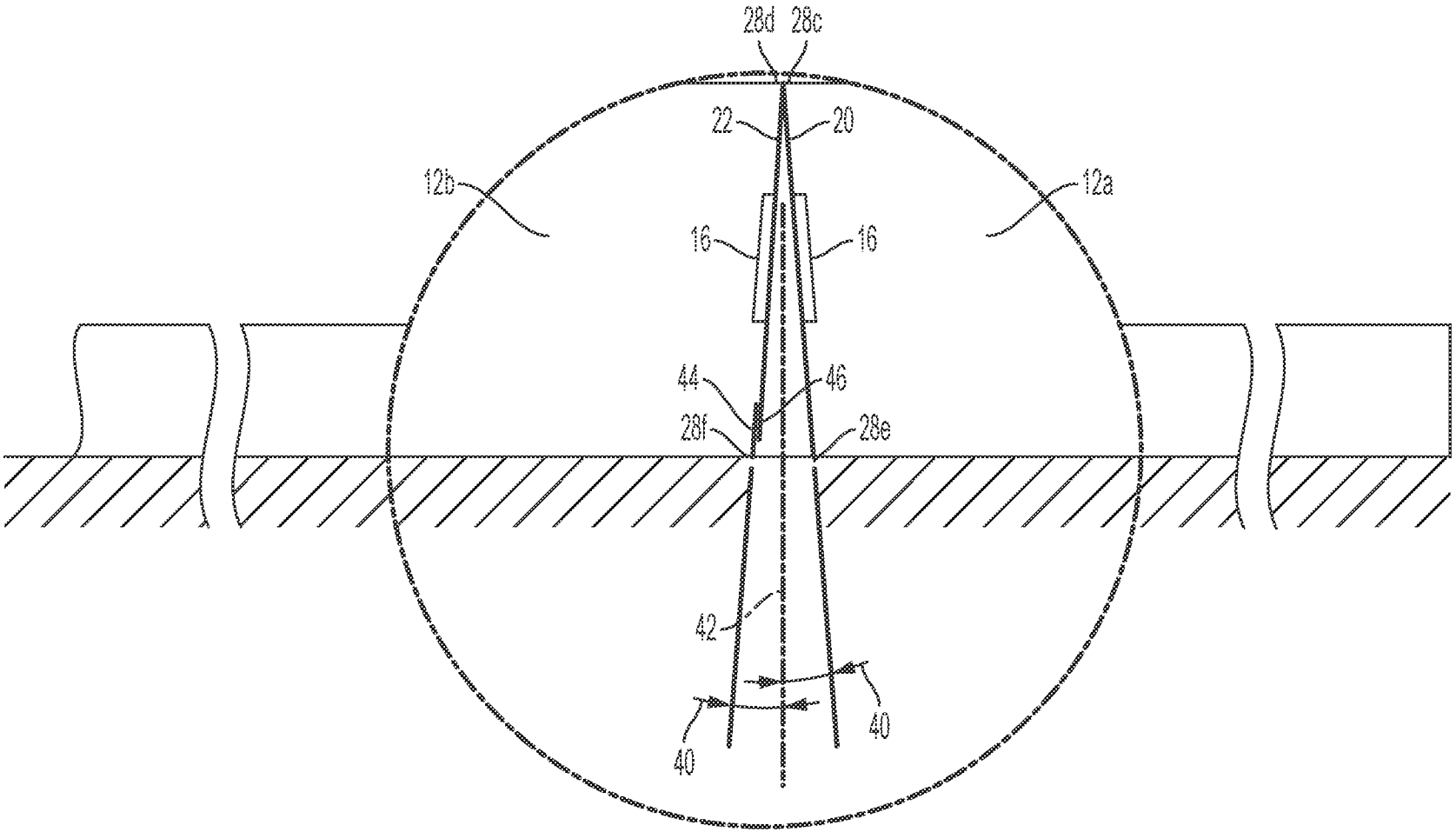
FIG. 2A is a top view of two adjacent/folding cartons that are laterally adjacent to each other.

As shown in FIGS. 2 and 2A, the tiles 10, 12 may have side panels 20, 22 and top and bottom flaps 26, 24 that are angled inward so that any outward curvature in the side panels 20, 22 and the top and bottom flaps 24, 26 do not bow out or cause the adjacent tiles 12 to lift off of a flat surface 28 of the wall 14. Referring now to FIG. 2, the bottom flap 26 of the tile 12*b* and the top flap 24 of the tile 12*c* is shown. The creases 28*a, b* (see FIGS. 2 and 13) between the top flap 24 and front panel 30 and the bottom flap 26 and the front panel 30 are shown. The creases 28*a, b* of the tiles 12*b, c* are shown as contacting each other. Because the top and bottom flaps 24, 26 are angled inward with respect to themselves 12*b*, 12*c*, any deformation (e.g., curvature) in the top and bottom flaps 24, 26 do not push out or significantly affect how the tiles 12*b*, 12*c* lays on the surface 28 of the wall 14. If the top and bottom flaps 24, 26 were to be bowed outward, such outward bowing may cause the opposed end portion 32 to lift off of the wall surface 28 as shown by gap 34, as shown by the dashed lines in FIG. 2. However, the angled relief 40 mitigates this aesthetically displeasing result or situation. Rather, as shown in FIGS. 2 and 2A, the magnets 16 are attracted to each other and thus, the top and bottom flaps 24, 26 are drawn to each other and the side panels 20, 22 are drawn to each other. The folding cartons/tiles pivot about the contact point defined by creases 28*a, b* in FIG. 2 and creases 28*c, d* in FIG. 2A. Because of this, no gap 34 is formed at the opposed end portion 32.

More particularly, referring back to FIG. 1, the system may include a plurality of folding cartons 10, 12. The folding carton 10 may be attached to the surface 28 of the wall 14, whereas, the adjacent tiles or folding cartons 12*a-i* may be disposed adjacent to the folding carton 10 and may be directly attached to the folding carton 10 as shown by folding cartons 12*a*, 12*c*, 12*f* and 12*h* or indirectly as illustrated by folding cartons 12*b*, 12*e*, 12*d*, 12*g* and 12*i*.

Figure 26:
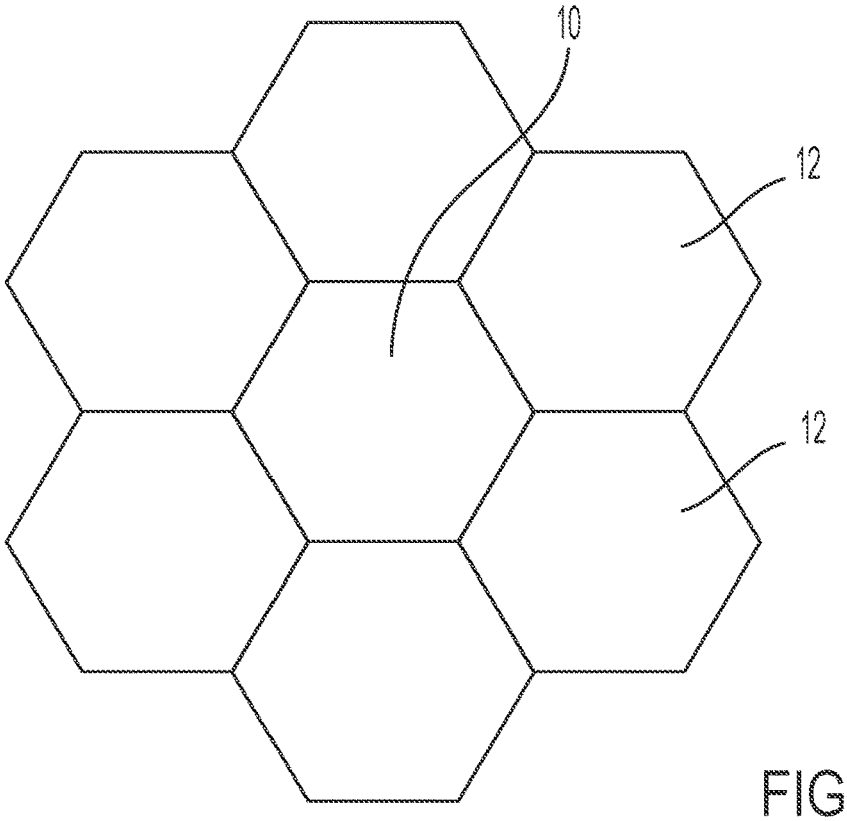
FIG. 26 illustrates a front view of a plurality of polygonal shaped tiles mounted to a surface.
Figure 27:
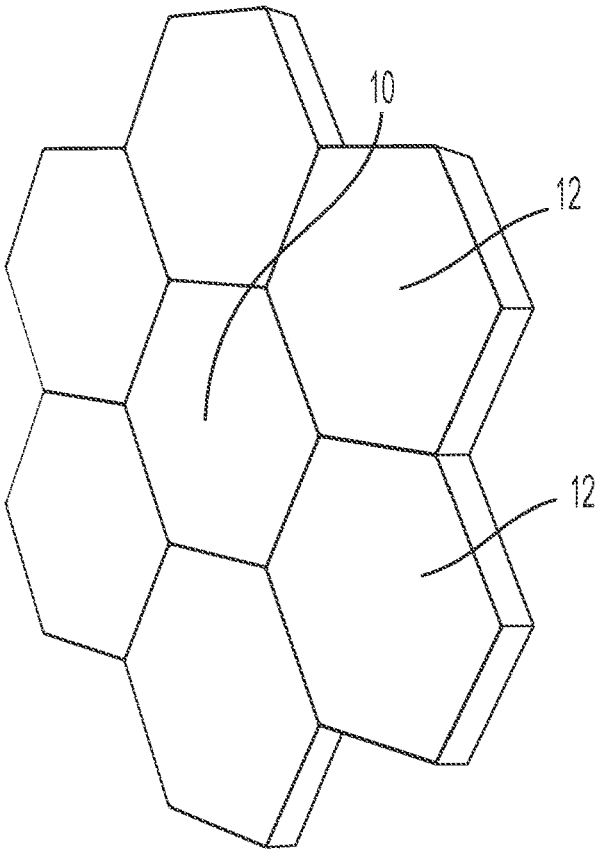
FIG. 27 illustrates a perspective view of the plurality of polygonal shaped tiles shown in FIG. 26.

The folding cartons 10, 12 shown in FIG. 1 is shown as having a square configuration. However, it is also contemplated that the folding cartons 10, 12 may have other configurations including but not limited to rectangular, triangular, polygonal (e.g. five sides, eight sides, etc.) as well as circular or oval configuration. By way of example and not limitation, FIGS. 26 and 27 illustrates a six sided tile 10, 12. These alternate shapes may incorporate the angular relief 40 shown in FIGS. 2 and 2A as well as the other aspects individually or collectively discussed herein to aid in the mounting of a plurality of alternate shaped tiles to a wall so that the alternate shaped tiles can be mounted upon a flat wall surface 28 of the wall 14 without a gap 34.

The folding cartons 10, 12 may be fabricated in the same manner as each other. Alternatively, differently shaped folding cartons 10, 12 may be attached to the wall and to each other.

The folding carton 10 may have a means for securing the folding carton 10 to the wall 14 including but not limited to magnets, adhesives, picture hanging hooks, French clips, screws. Preferably, the folding carton 10 may have a magnet used to secure the folding carton 10 to the wall 14. The magnet is preferable because the magnet makes it easy to attach the folding carton 10 to a wall, adjust the folding cartons 10, 12 and detach the folding cartons 10, 12 off of the wall without damaging the wall 14 and off of each other. By easy, it is meant that no tools are required to attach, move or adjust the position of the tile. When a magnet 16*a* is used to secure the folding carton 10 to the wall 14, the magnet 16*a* may be centered about a length 36 and width 38 of the rear panel 18. The magnet 16*a* may be secured to an interior side of the folding carton 10 so that the magnet 16*a* is not visibly exposed as well as the magnet 16*a* does not lift the folding carton 10 off of the surface 28 of the wall 14. Moreover, although only one magnet 16*a* is shown in FIG. 13 attached to the rear panel 18, a plurality of magnet 16*a* may be secured to the rear panel 18 as needed. When a plurality of magnet 16*a* is attached to the rear panel 18, the plurality of magnet 16*a* may be evenly distributed on the rear panel 18.

As discussed above, the folding carton 10 may be secured to the wall 14 in alternate ways. By way of example and not limitation, if an adhesive is used, then the adhesive may be a thin pressure sensitive adhesive secured to an exterior side of the rear panel 18. To secure the tile or folding carton 10 to the wall 14, the pressure sensitive film adhesive may be secured to the exterior surface of the rear panel 18. The top or bottom flaps 24, 26 may be undone so that the user can insert a finger or hand into the folding carton 10 and press the adhesive against the surface 28 of the wall 14. Alternatively, an insert that fills the space within the folding carton 10 may be inserted into the folding carton 10. Once the folding carton 10 is erected, the adhesive of the pressure sensitive film adhesive is exposed. The user can press on the front of the box to apply pressure to the pressure sensitive film adhesive through the insert. The insert can be a solid structure, honeycomb structure, etc. or any other structure sufficient to transfer the push force applied to the front of the folding carton 10 to the adhesive on the back of the folding carton 10.

To attach the adjacent tiles 12*a-i* to each other or to the folding carton 10, the magnets 16*b-i* may be incorporated into the top and bottom flaps 24, 26 and the side panels 20, 22 of each of the folding cartons 12*a-n*. Reference to folding carton 12"*n*" refers to an unknown number of folding cartons 12. In FIG. 13, the side panels 20, 22 and the top and bottom flaps 24, 26 are shown as having two magnets per panel/flap 20, 22, 24, 26. However, it is also contemplated that each panel/flap 20, 22, 24, 26 may incorporate one or more magnet 16. It is further contemplated that the panels/ flaps 20, 22, 24, 26 may have one or more magnets 16. In this regard, one or more panels/flaps 20, 22, 24, 26 may have one or more magnets 16. For example, folding carton 12*a* shown in FIG. 1 does not need magnets in side panel 22 and the top flap 24. Because the side panel 22 and the top flap 24 does not have any other folding carton 12 adjacent to it, no magnets are needed. The magnets 16 may be employed in the side panel 20 of folding carton 12*a* and the bottom flap 26 of the folding carton 12*a*. These magnets 16 may be used to attach the folding carton 12*a* to folding carton 12*b* and the folding carton 10.

Figure 11A:
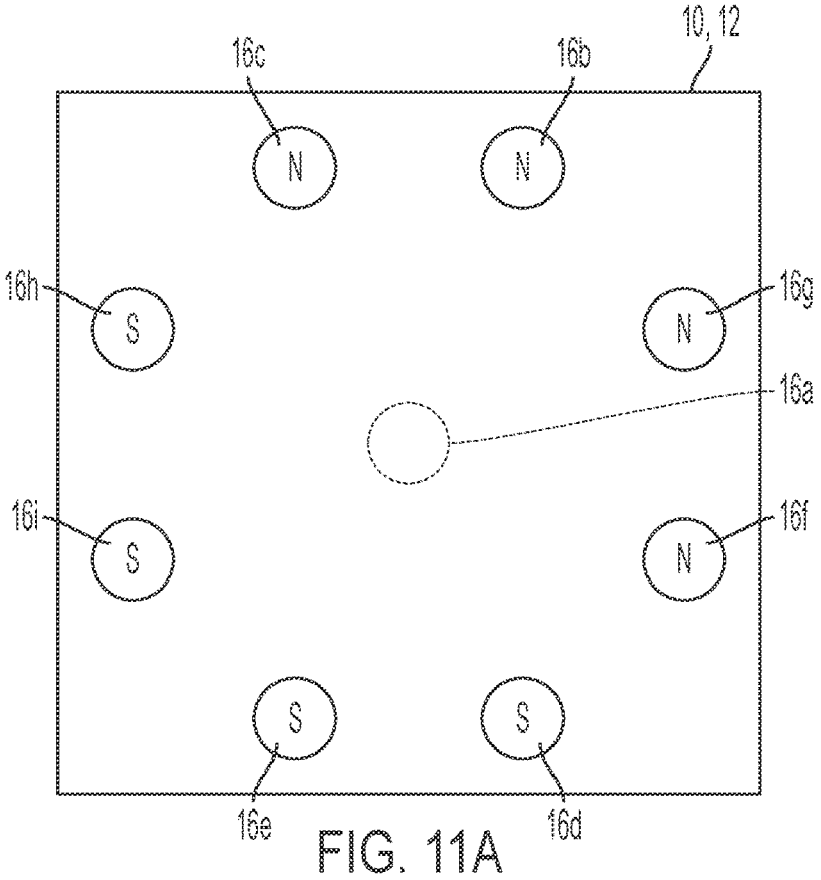
FIG. 11A illustrates a first embodiment of a magnet configuration.
Figure 11B:
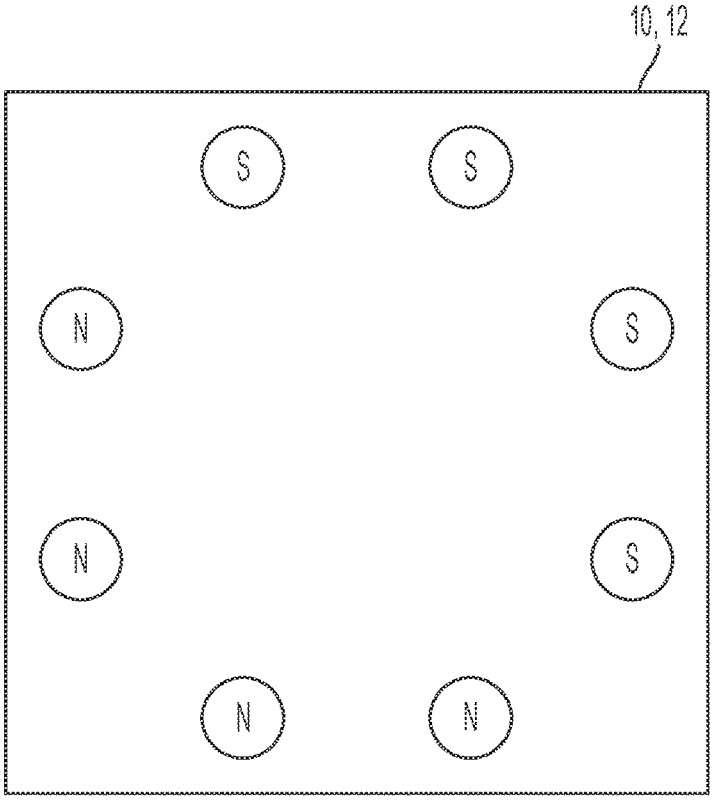
FIG. 11B illustrates a second embodiment of the magnet configuration.
Figure 11C:
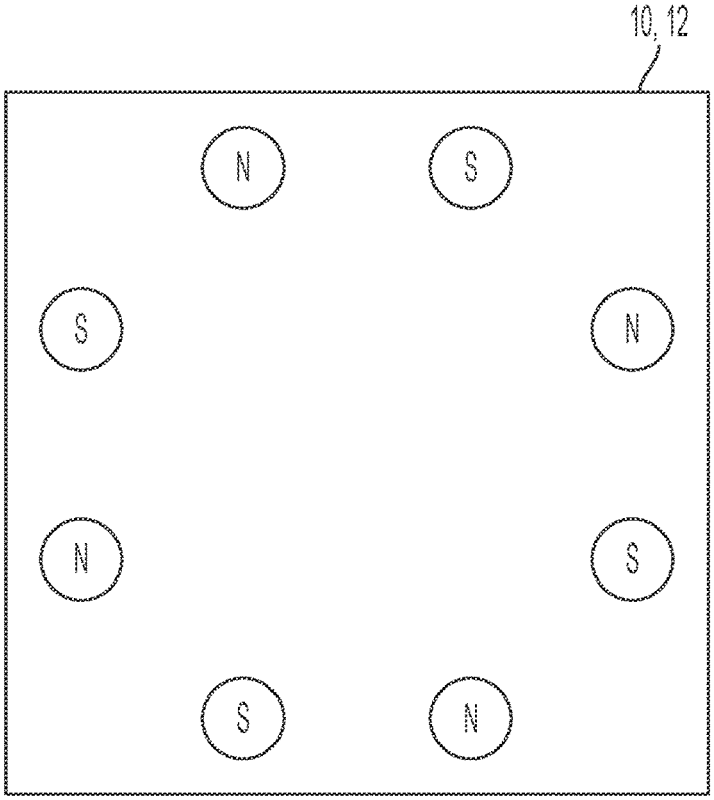
FIG. 11C illustrates a third embodiment of the magnet configuration.
Figure 11D:
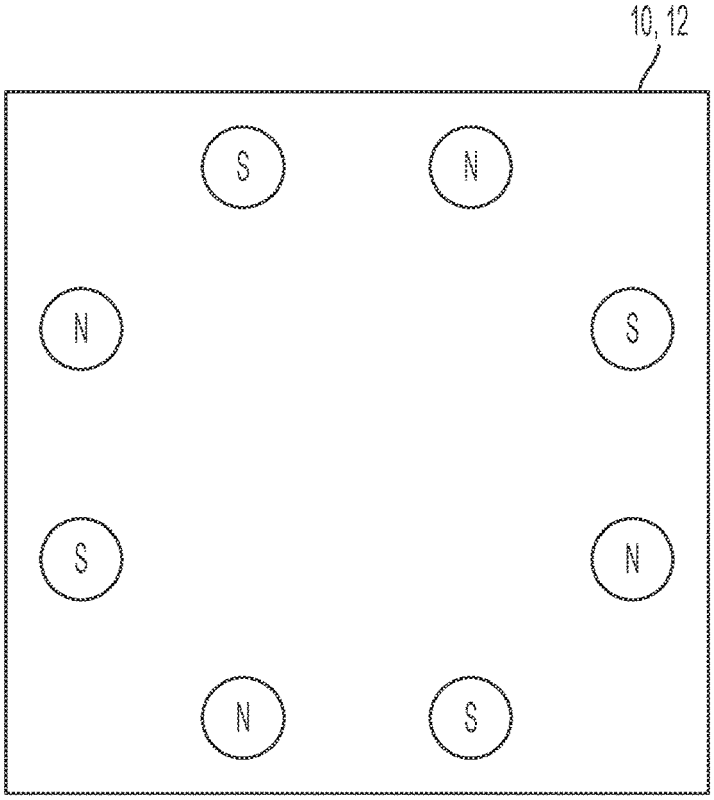
FIG. 11D illustrates a fourth embodiment of the magnet configuration.
Figure 11E:
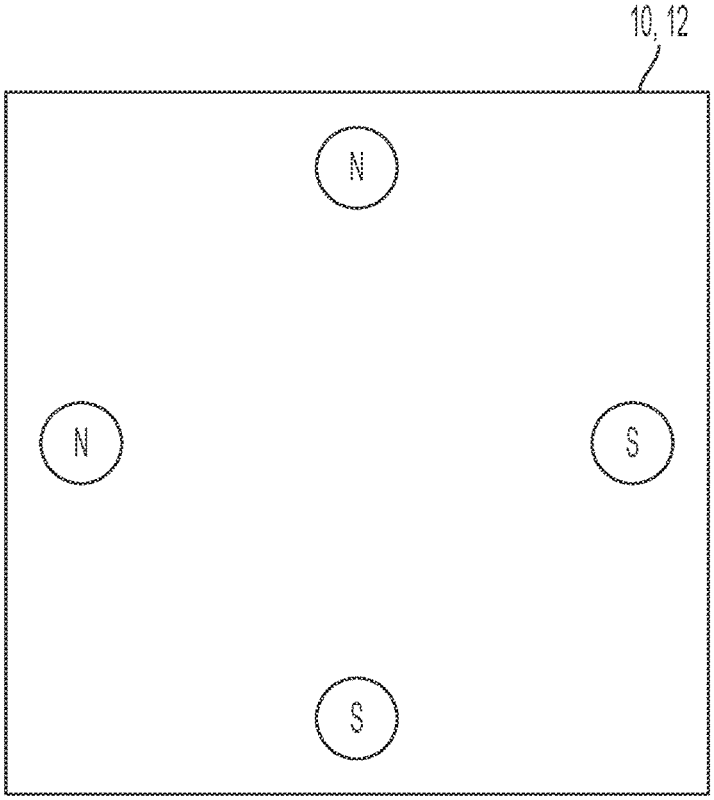
FIG. 11E illustrates a fifth embodiment of the magnet configuration.
Figure 11F:
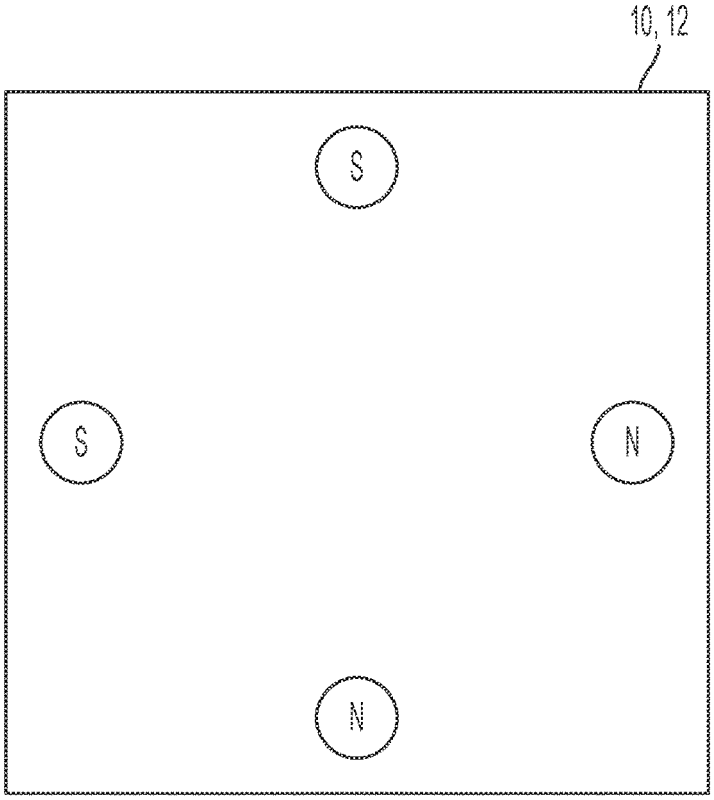
FIG. 11F illustrates a sixth embodiment of the magnet configuration.
Figure 11G:
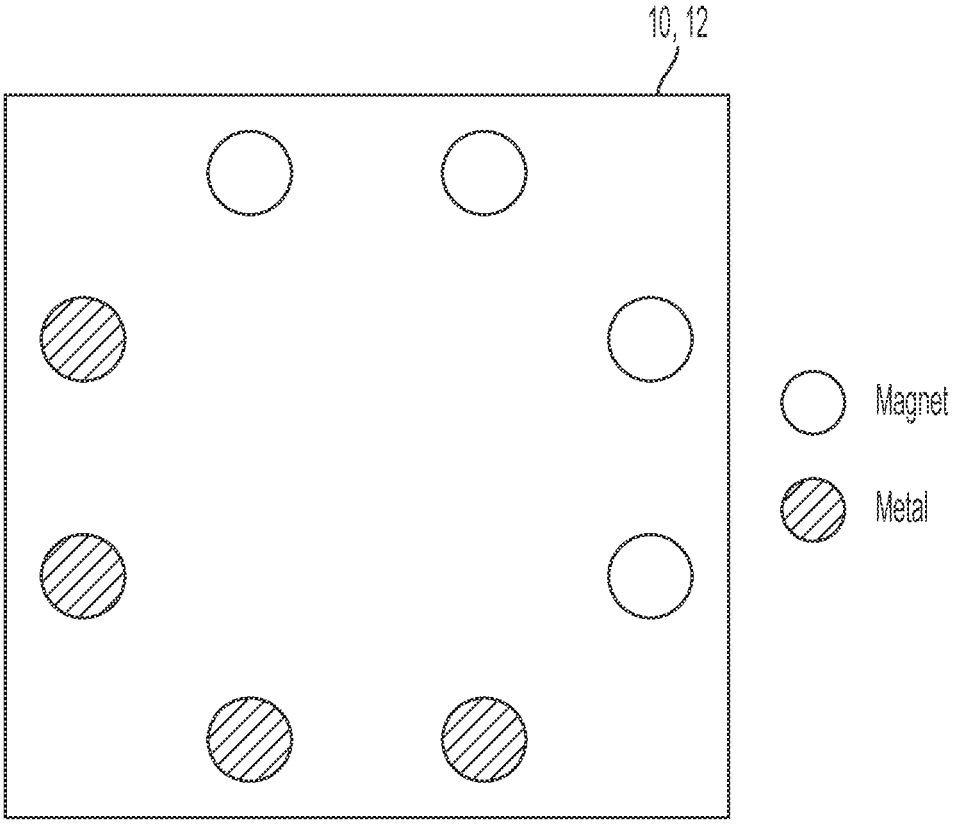
FIG. 11G illustrates a seventh embodiment of the magnet configuration.
Figure 12:
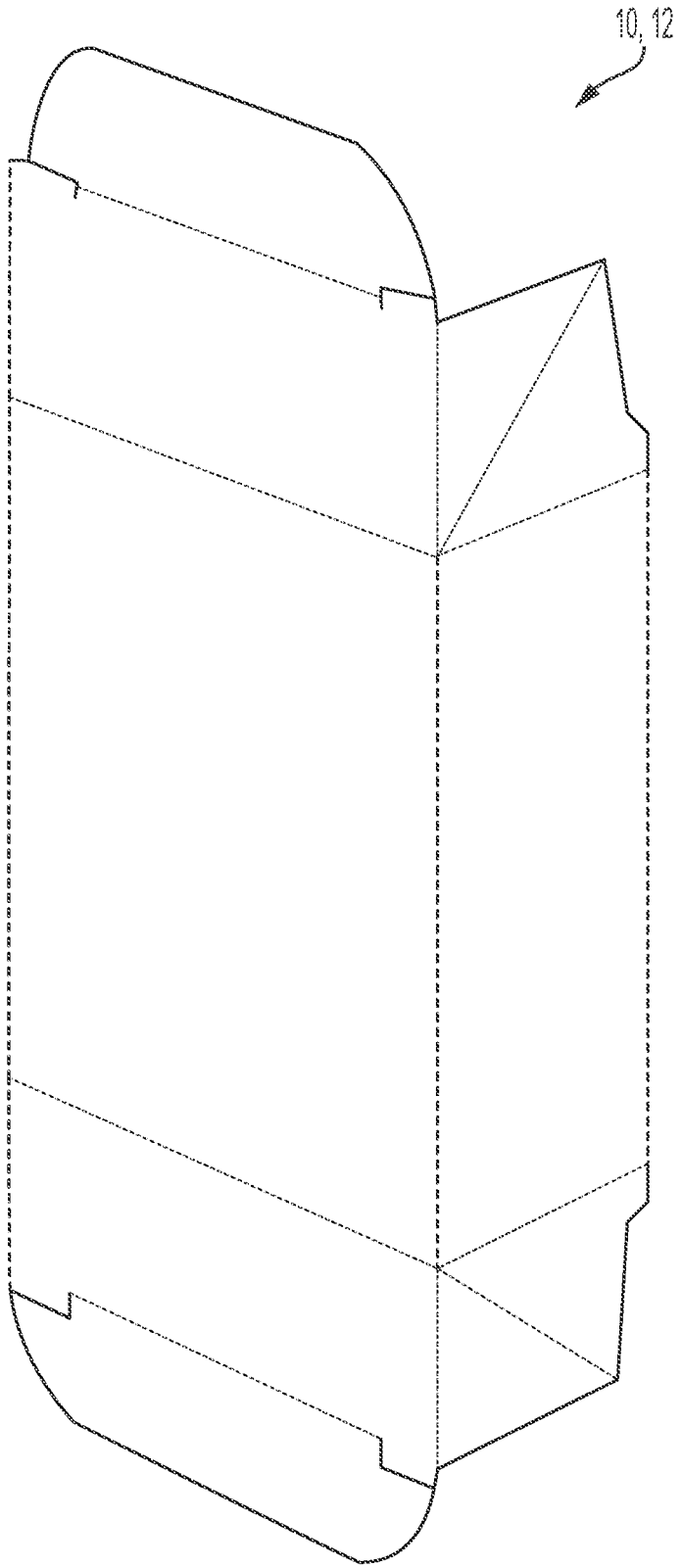
FIG. 12 illustrates a first folding carton style of the tile.

Referring now to FIG. 11A, the plurality of the magnets 16*b-i* are shown. In this regard, the magnet 16*d, e* of an upper folding carton 10, 12 may be attracted to the magnets 16*b, c* of the lower folding carton 10, 12. Likewise, the magnet 16*g, f* of a left folding carton 10, 12 may be attracted to the magnet 16*h, i* of the right folding carton 10, 12. Other configurations of the polarities of the magnet 16*b-i* are also contemplated. By way of example and not limitation, these alternate configurations are shown in FIGS. 11B-G. The magnets 16*b-n* may be secured to the interior side of the side panels 20, 22, flaps 24, 26 as shown in FIGS. 3, 5, 5A, and 6. The magnets 16*a-i* may be secured to the interior surfaces of the rear panel 18, side panels 20, 22 and the top and bottom flaps 24, 26 by way of an adhesive (e.g. pressure sensitive adhesive, permanent adhesive, glue) or a bracket that holds the magnets and wherein the bracket is attached to the respective panel or flap.

Referring back to FIG. 2, the top and bottom flaps 24, 26 may have an angled relief 40. The angled relief 40 may be measured from a plane 42 that is perpendicular from the front panel 30 of the folding carton 10, 12. As shown, the top and bottom flaps 24, 26, are angled inward from a direction from creases 28 *a, b* to creases 28 *c, d* (see FIG. 13 and see FIG. 2).

When the folding carton 10, 12 is erected, the creases 28*c*, 28*d* shown in FIG. 13 are also aligned to edges 42 *a, b* (FIG. 13). The angled relief 40 is shown with respect to the top and bottom flaps 24, 26. However, the angled relief may also be formed in the side panels 20, 22. The side panels 20, 22 are angled inward from creases 28*c, d* to creases 28*e, f* (see FIG. 2A). When the folding carton is folded and glued, the glue flap 44 is attached to the interior side of the side panel 22. The edge 46 is slightly offset inward so that a width 48 is slightly smaller than a height 50, defined by the side panels 20, 22 of the folded and erected folding carton 10, 12. Hence, the angled relief 40 is described with respect to the side panel 22 as being angled inward from the crease 28*d* to the crease 28*f*. The edge 46 in FIG. 2A is being shown as being slightly offset or above the crease 28*f*.

To create the angled relief 40 in the top and bottom flaps 24, 26 shown in FIG. 2, a length 38 (see FIG. 13) of the rear panel 18 may be smaller than a length 50 (see FIG. 13) of the front panel 30. Additionally, creases 52*a, b* may be angled inward by an angle 54, as shown in FIG. 13. The angel 54 by which the crease 52*a* extends from the front panel 30 to the rear panel 18 defines the angular degree of the angled relief 40. The angled relief 40 may be angled at the same angle as the angle 43. The angled relief 40 of the top and bottom flaps 24, 26 may be the same as each other. In this regard, the angle 54 of crease 52*a* may be equal to the angle 54 for crease 52*b*. However, it is also contemplated that the angled relief 40 of the top and bottom flaps 24, 26 may be different from each other. In this regard, the angle 54 for crease 52*a* may be different from the angle 54 for crease 52*b*. Preferably, the angle 54 may be from 0.5 degrees to 20 degrees. Additionally, it is also contemplated that only one of the creases 52*a* or 52*b* may be angled inward so that the other angle 54 or angled relief 40 is zero degrees. The length 38 of the rear panel 18 may be dictated by the length 50 of the front panel 30 and the angle 54 of the creases 52*a, b*.

It is also contemplated that neither of the creases 52*a, b* are angled inward so that the angle 54 is zero degrees. In this regard, flaps 24, 26 will provide for no angled relief. This configuration may be employed when no other folding carton 10, 12 is attached to the upper and lower flaps 24, 26. By way of example and not limitation, the tile 12*i* does not have any other tile 12 attached to the upper or lower sides of the tile 12*i*. In this regard, tile 12*i* may not provide for an angled relief 40 in the upper and lower flaps 24, 26.

To provide for the angled relief 40 shown in FIG. 2A, the side panels 20, 22 may be angled inward. In this regard, the width 36 of the rear panel 18 may be smaller than the width 56 of the front panel 30. The angle 40 shown in FIG. 2A of the side panels 20, 22 may be a function of the difference of width 36 of the rear panel 18 and width 56 of the front panel 30 as well as the widths 48 of the side panels 20, 22. These variables may be adjusted to allow for an angled relief 40 of the side panels of from 0.5 degrees to 20 degrees. The rear panel 18 may reside centrally behind the front panel 30 when the folding carton 10, 12 is erected (i.e., top and bottom flaps 24, 26 are folded in).

The magnets attached to the top and bottom flaps 24, 26 and the side panels 20, 22 may be positioned on the side panels 20, 22 and top and bottom flaps 24, 26 so that the tiles 10, 12 are aligned to each other. For example, the magnets can be positioned on the side panels 20, 22 at the same distance to a common crease or panel/flap for adjacent folding cartons 10, 12 that will be attached to each other. In this regard, the magnets of adjacent folding cartons 10, 12 will be attracted to each other at the same location so that the top flaps 24 of adjacent tiles 10, 12 are within the same plane when attached to each other. Likewise, the side panels 20, 22 and the bottom flaps 26 may be aligned to adjacent tiles 10, 12 when attached to each other.

The tiles 10, 12 shown in FIG. 1 may be fabricated from a folding carton style known as a straight tuck folding carton. The straight tuck folding carton is shown in FIG. 13. A benefit of the straight tuck folding carton style is that there is no exposed cut edge in the front panel 30, side panels 20, 22 and the top and bottom flaps 24, 26. However, it is also contemplated that the various aspects and features described herein may be employed in other styles of folding cartons. The other styles of folding cartons are shown in FIGS. 14-25.

Figure 3:
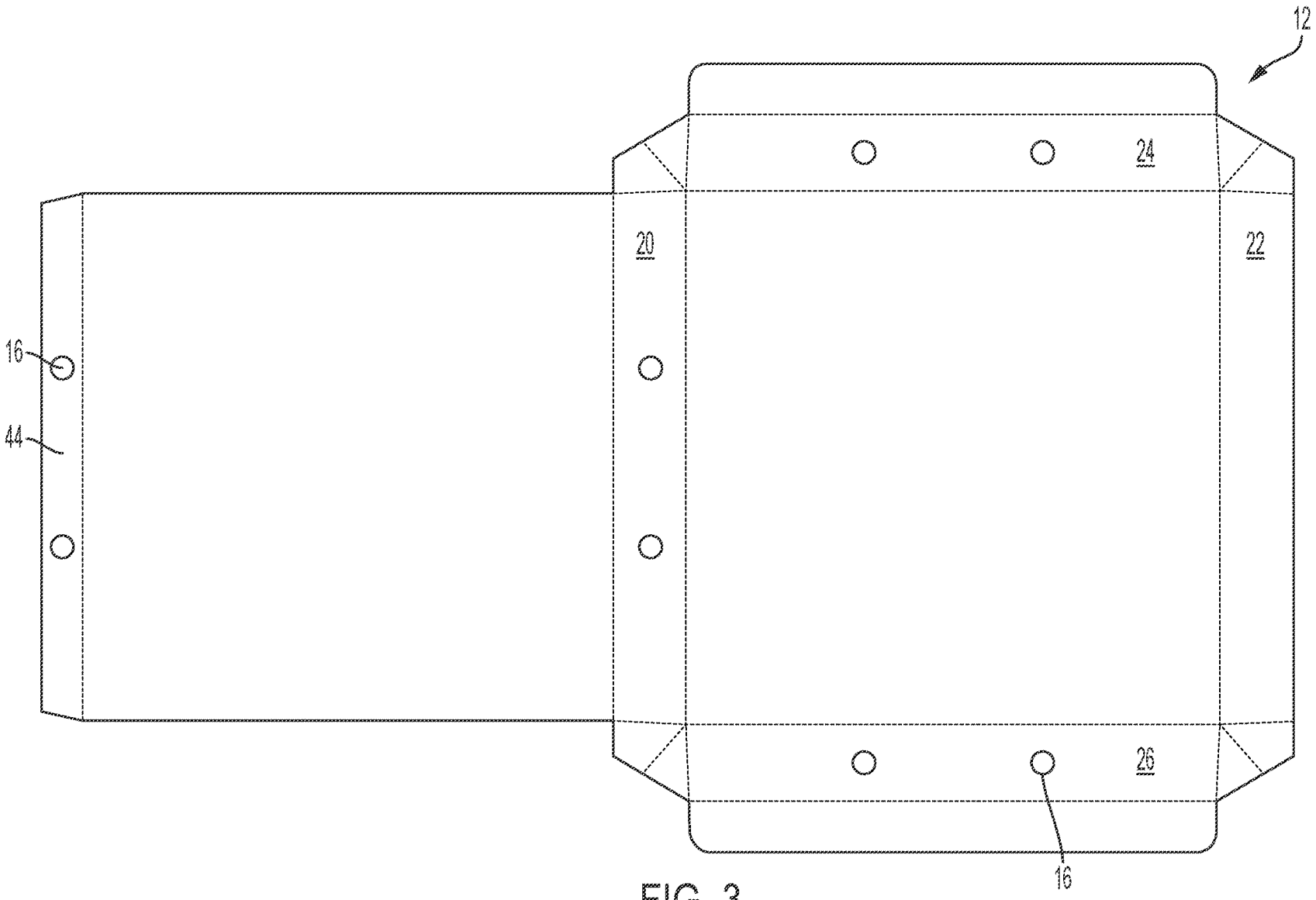
FIG. 3 illustrates an interior view of a folding carton.
Figure 4:
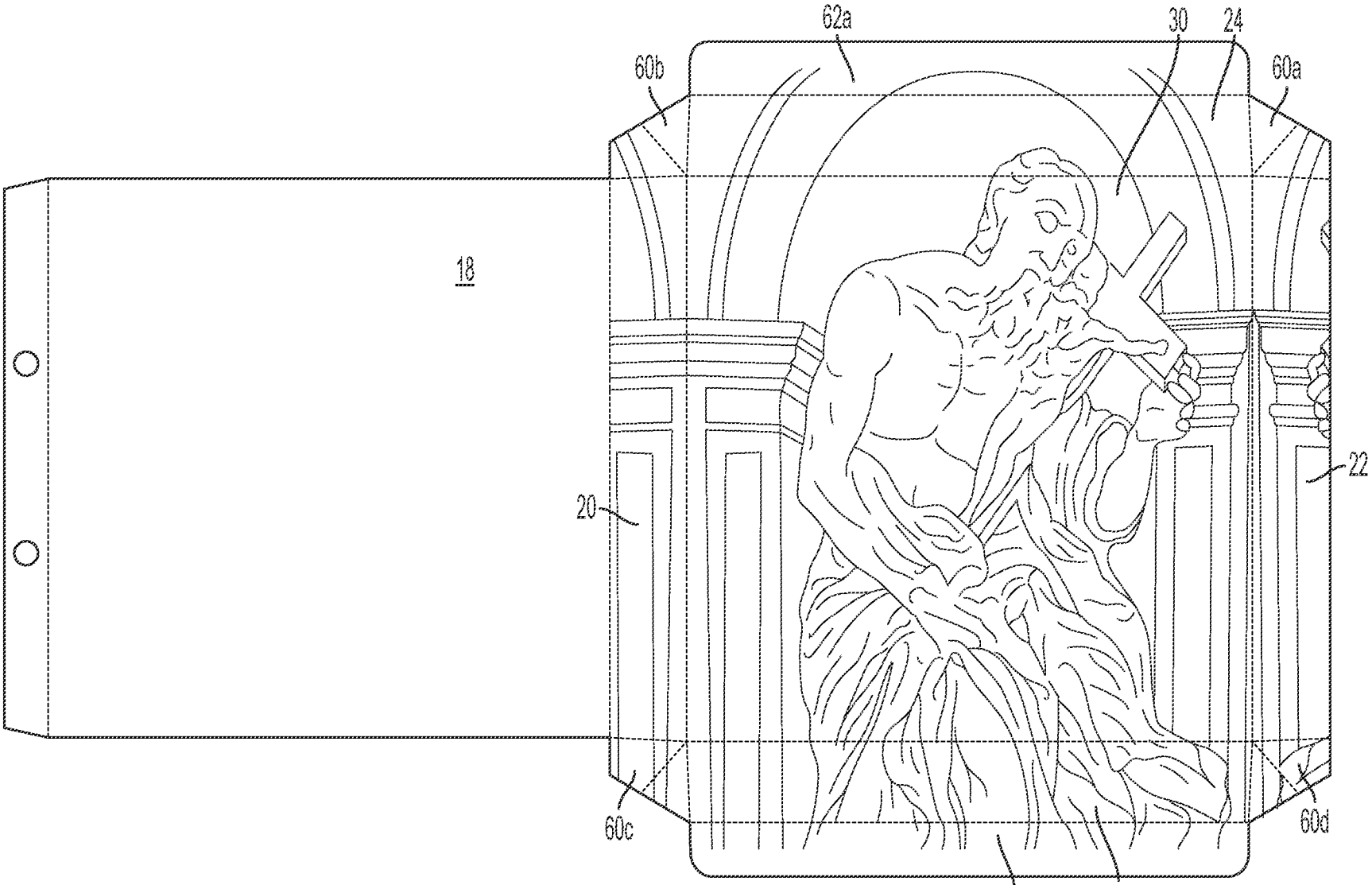
FIG. 4 illustrates an exterior view of the folding carton shown in FIG. 3.
Figure 5:
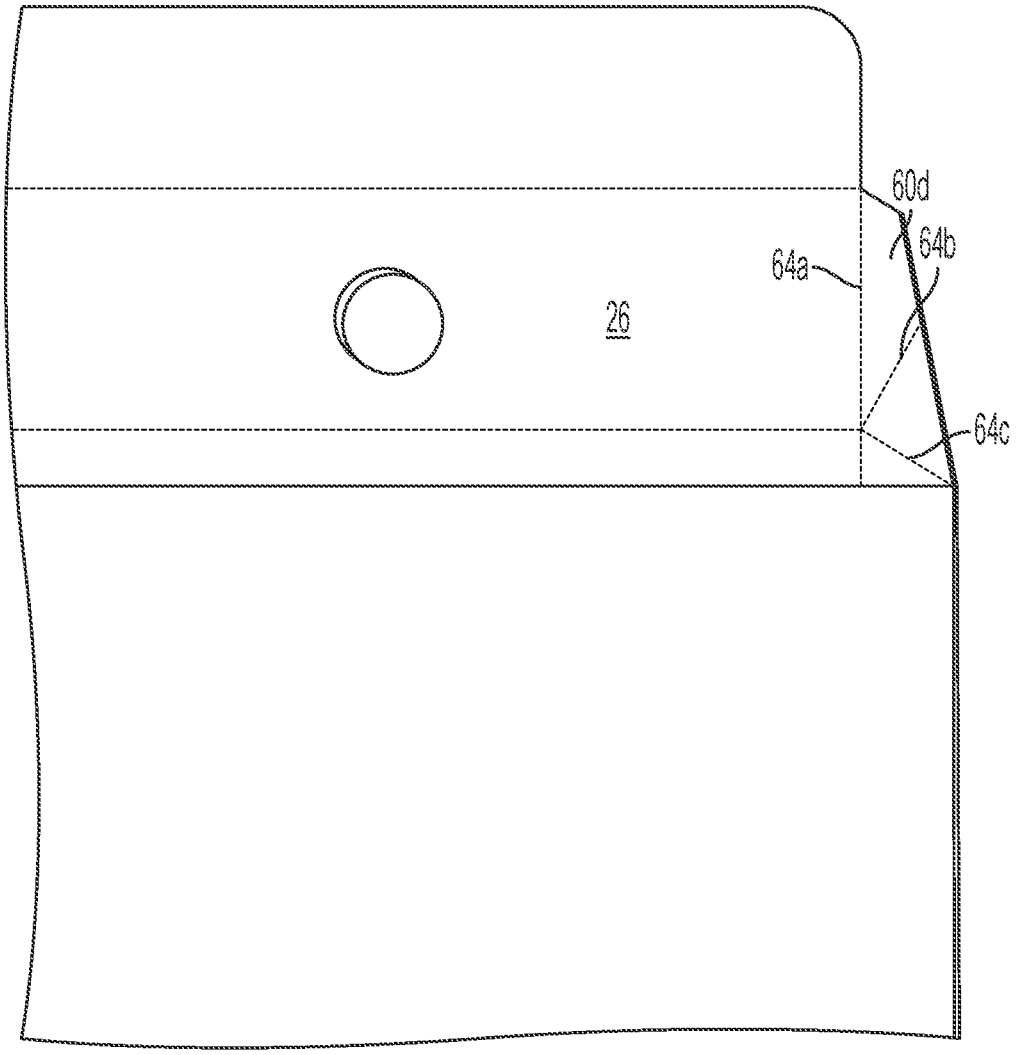
FIG. 5 is a perspective view of a top flap and dust flap of the folding carton.
Figure 5A:
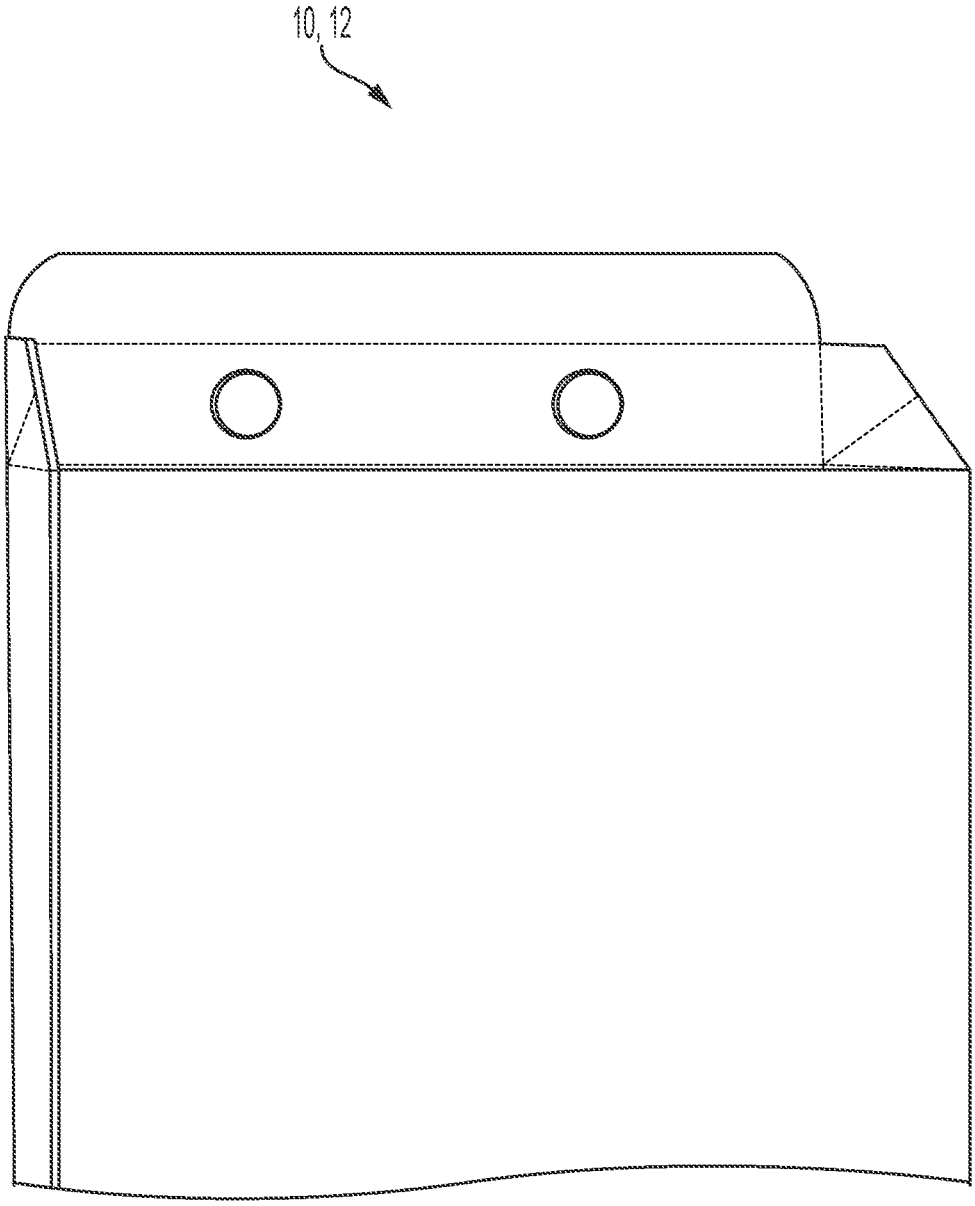
FIG. 5A illustrates a different perspective view of the folding carton.
Figure 6:
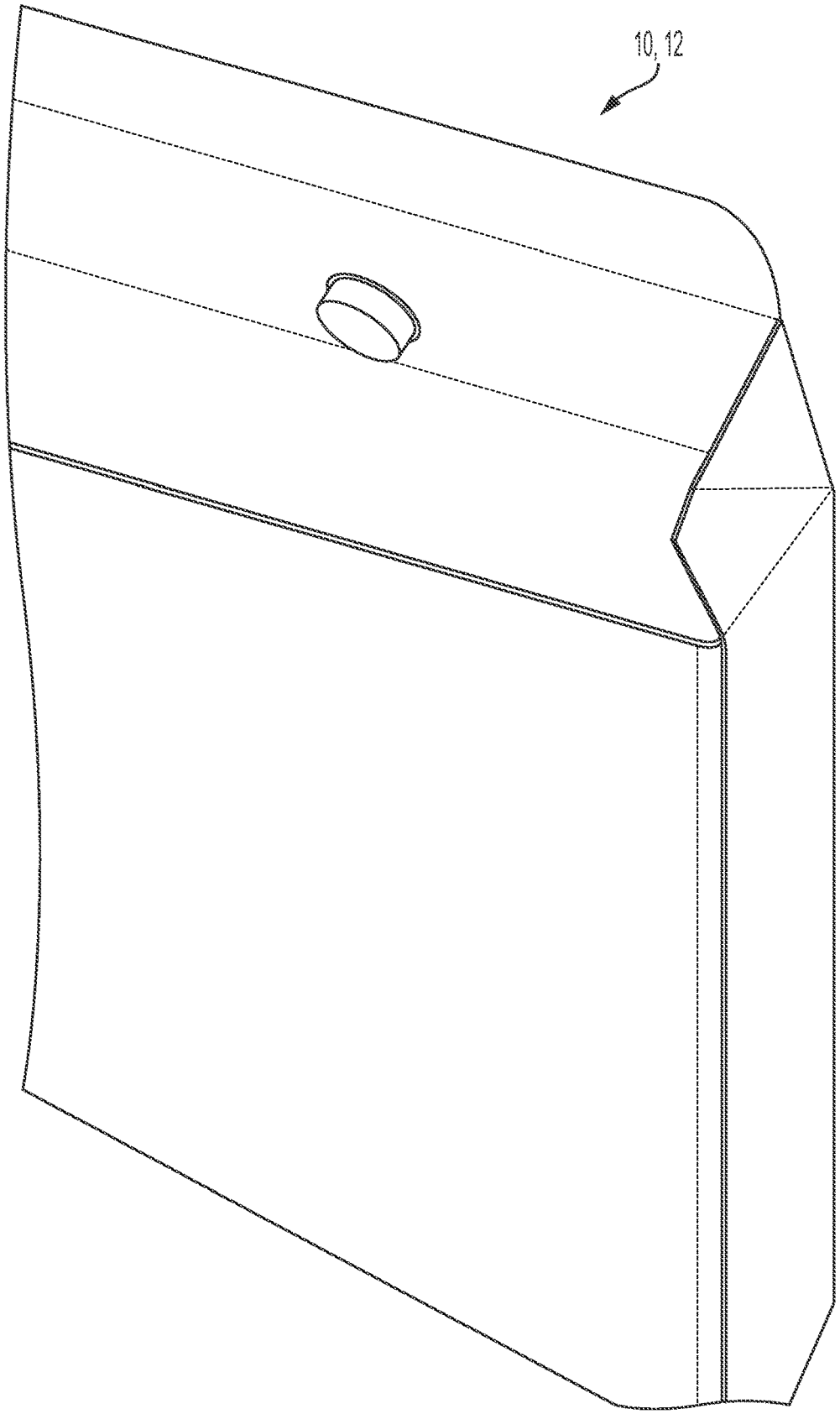
FIG. 6 illustrates a different perspective view of the folding carton.
Figure 7:
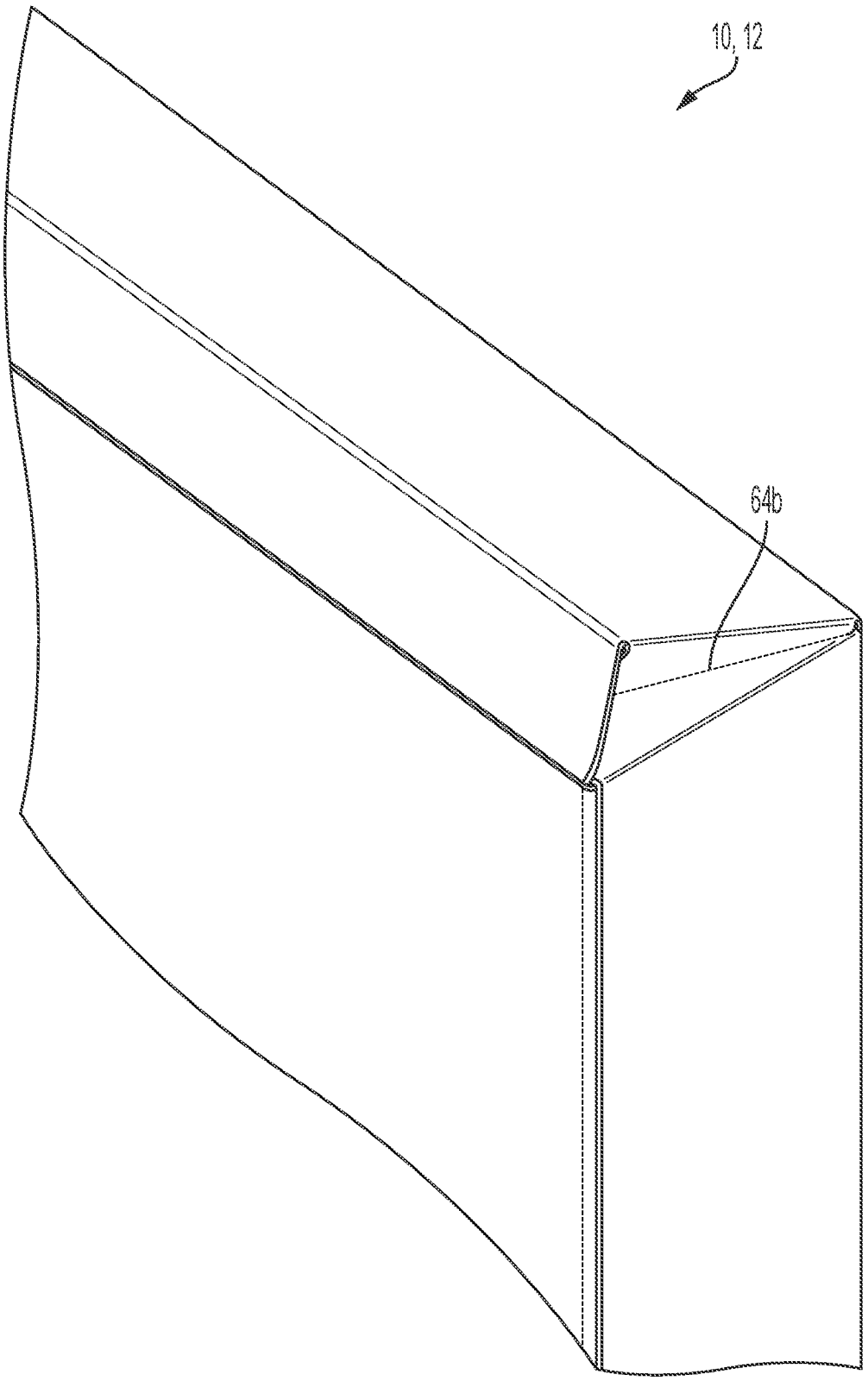
FIG. 7 illustrates the dust flap being inserted and the top flap being closed.
Figure 8:
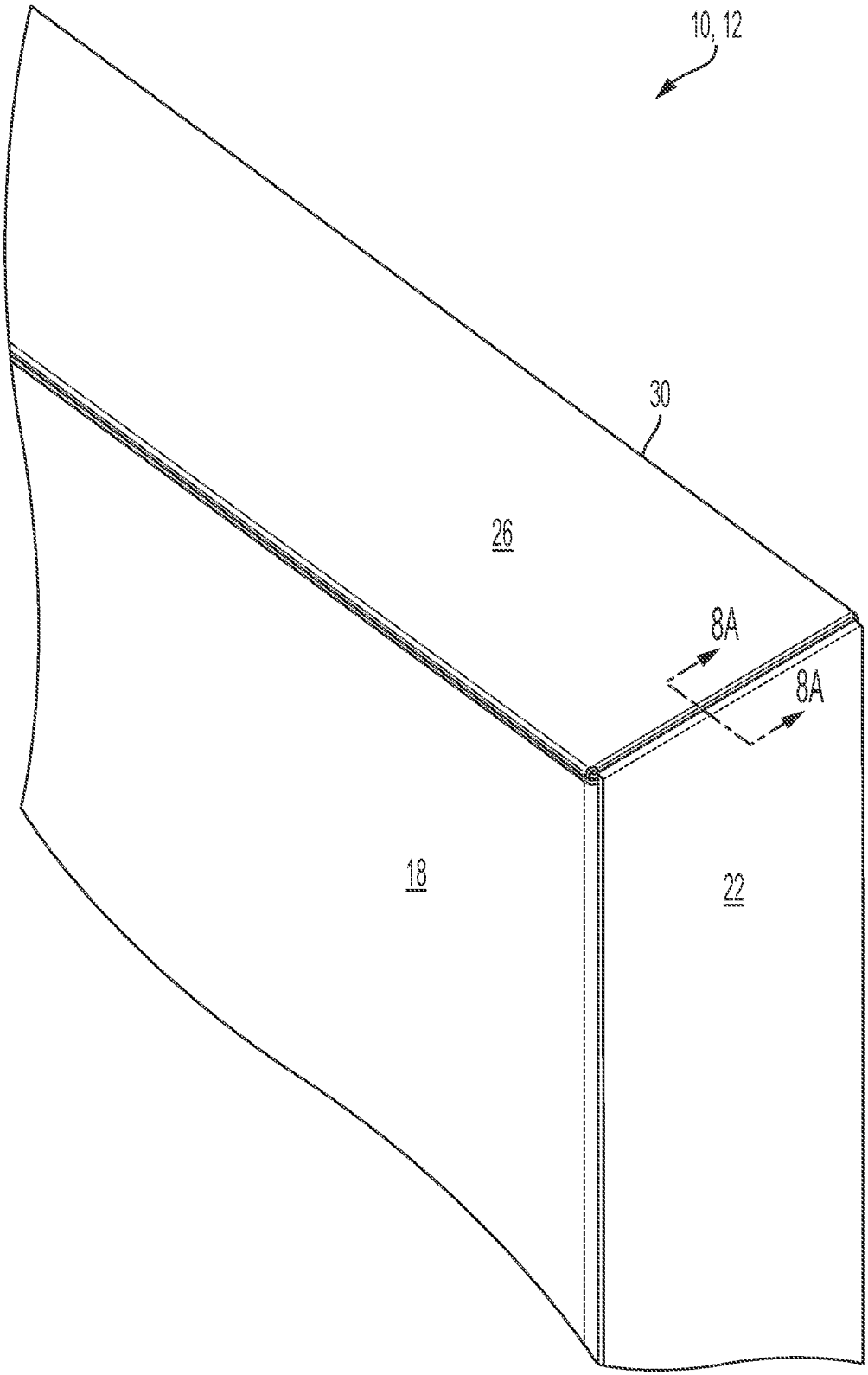
FIG. 8 illustrates that no cut edge is exposed at the junction between the top flap and the side panel.
Figure 8A:
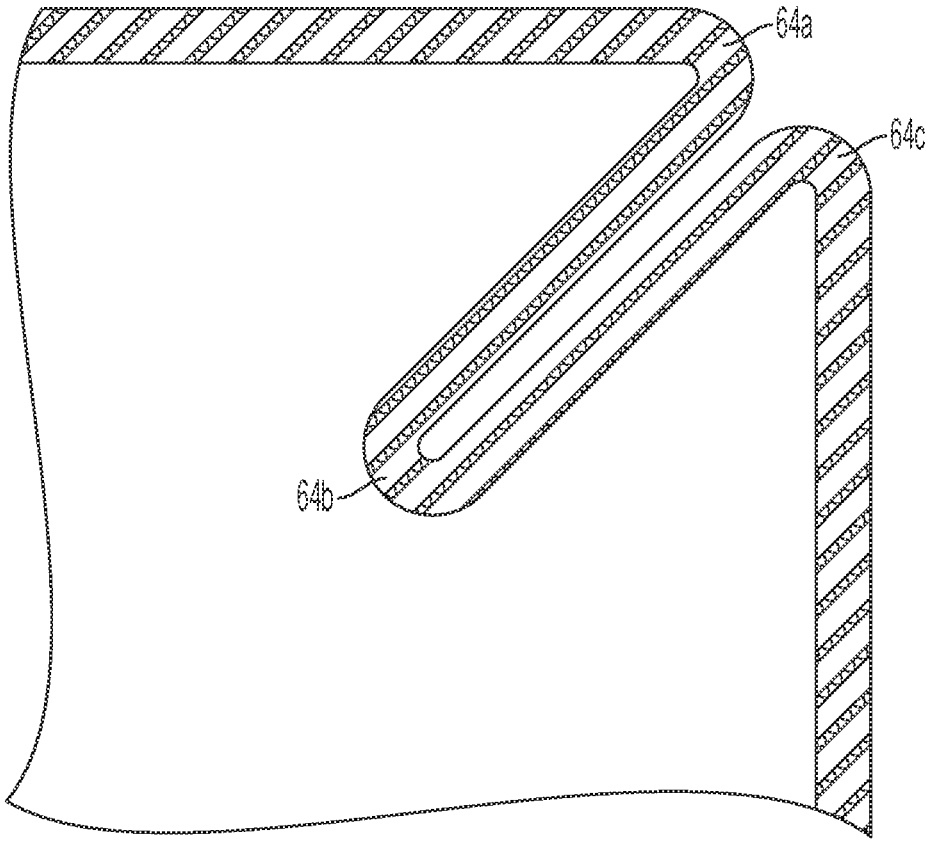
FIG. 8A is a cross sectional view of the folding carton shown in FIG. 8 illustrating the dust flap tucked into the folding carton so that no cut edge is exposed between the flap and the side panel.
Figure 9:
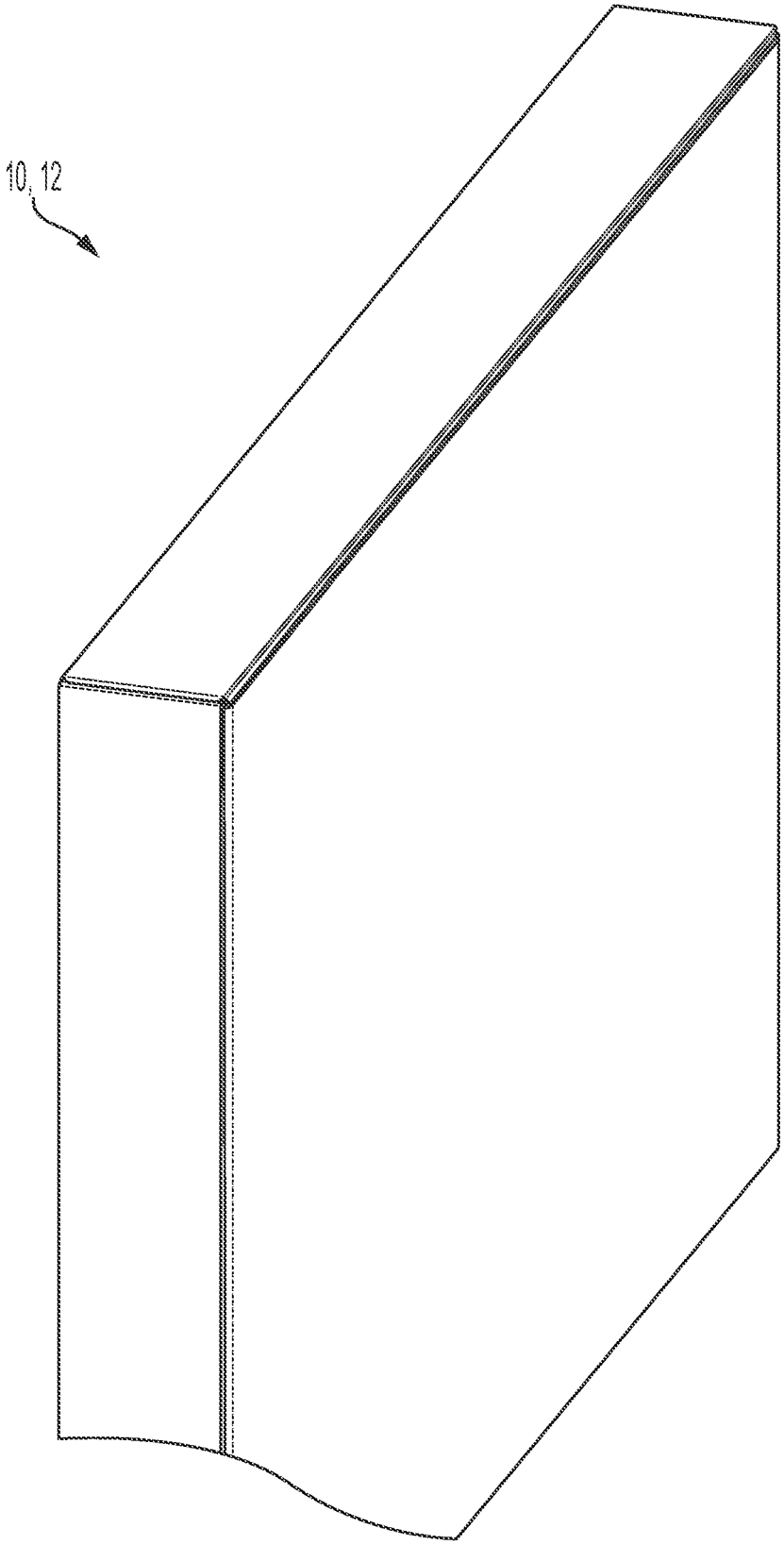
FIG. 9 illustrates a perspective view of the folding carton.
Figure 10:
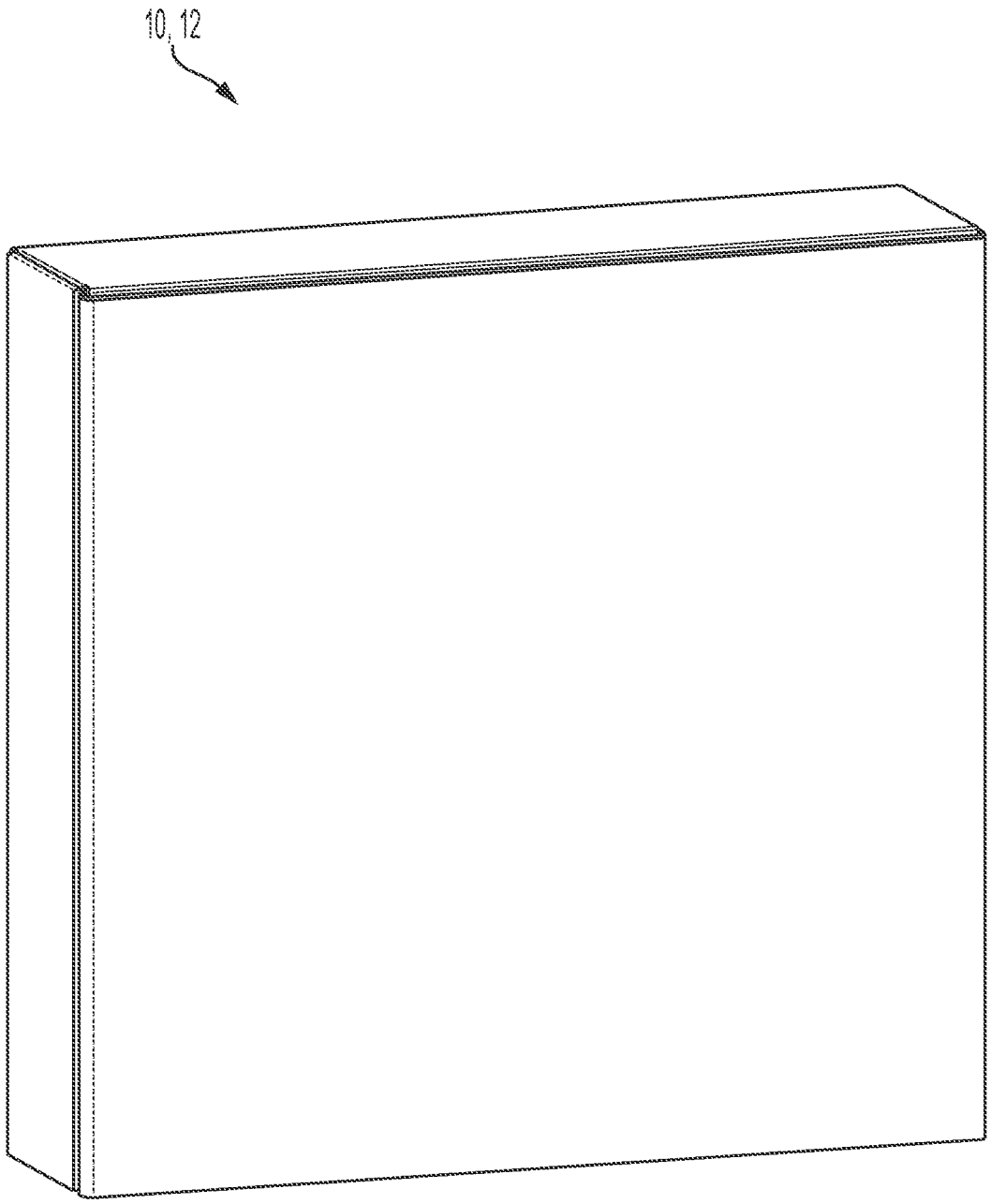
FIG. 10 illustrates a different perspective view of the folding carton.

Referring now to FIG. 3, an inside surface of the folding carton 12 is shown. The magnets 16 may be attached to the top and bottom flaps 24, 26 as well as side panel 20. To attach the magnet(s) 16 to the side panel 22, magnet(s) 16 may be secured to the glue flap 44. The folding carton 10, 12 may be folded and the glue flap 44 may be glued or secured to the side panel 22, the magnet(s) 16 on the glue flap 44 is essentially positioned over and on the side panel 22. Referring now the FIG. 4, an exterior side of the folding carton 12 may have an image printed thereon. The image may cover the entire front panel 30 as well as the top and bottom flaps 24, 26 as well as side panels 20, 22. The image may also bleed onto the dust flaps 60*a-d*. Additionally, the image may bleed onto the back panel 18 though it is not shown in FIG. 4. The image may also bleed onto the insertion tabs 62*a, b*. The image may bleed onto these other areas so that the image shows a continuous wrapped around appearance when the folding carton is mounted to the wall. When the folding carton 10, 12 is folded and glued as well as erected, the image may be shown on the front panel 30, top and bottom flaps 24, 26 and the side panels 20, 22.

Referring now to FIGS. 5-10, the dust flaps 60*a-d* of the folding carton 10, 12 is shown. The dust flap 60*d* may be attached to the top flap 26 and may form a crease with the top flap 26. The dust flap 60*d* may be folded in by pushing the crease 64*b* inward toward a central area of the folding carton 10, 12. In this regard, the exterior or visible portion of the box has a crease 64*a, c* and not a cut edge.

In FIGS. 3-8, dash lines generally represent creases in the folding carton and solid lines represent cut lines unless the context indicates otherwise. In FIG. 3, the round circles are the magnets and do not represent cut lines in the folding carton 10, 12. The folding carton 10, 12 may be fabricated from paper. The thickness of the paper may be from 0.006 inches to 0.036 inches. Preferably, the thickness of the paper from which the folding carton is printed, die cut, and glued may be between 0.012 inches to 0.020 inches. The folding carton 10, 12 may be fabricated from other materials including but not limited to corrugated material, plastic sheets, paper and plastic laminated material.

Various aspects of the folding carton 10, 12 have been described with the top and bottom flaps being oriented vertically. However, it is also contemplated that the various tiles/folding cartons 10, 12 may be oriented at different orientations (e.g., 90 degree clockwise or counterclockwise direction). The terms top and bottom for the flaps 24, 26 were used for convenience and not meant to fix the orientation of the folding carton 10, 12.

The wall discussed herein may be a metal plate (e.g., metal whiteboard). The metal plate may be exposed, painted over or overlaid with a coating or laminate. Nevertheless, these are examples of a wall. It is also contemplated that the wall may be other structures as well such as a refrigerator door or a plastered wall with a metal plate to which the magnet 16*a* can be attached to. Moreover, it is also contemplated that the folding carton 10, 12 may be a stand alone object which is hung on a tree or propped up on a desk.

Figure 28:
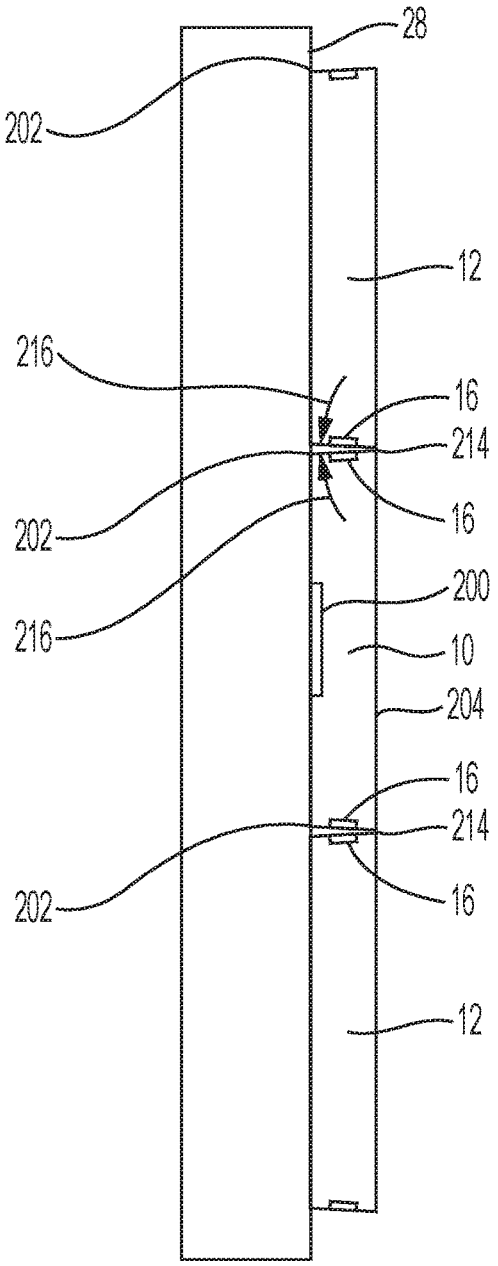
FIG. 28 is a side view of a plurality of tiles.
Figure 29:
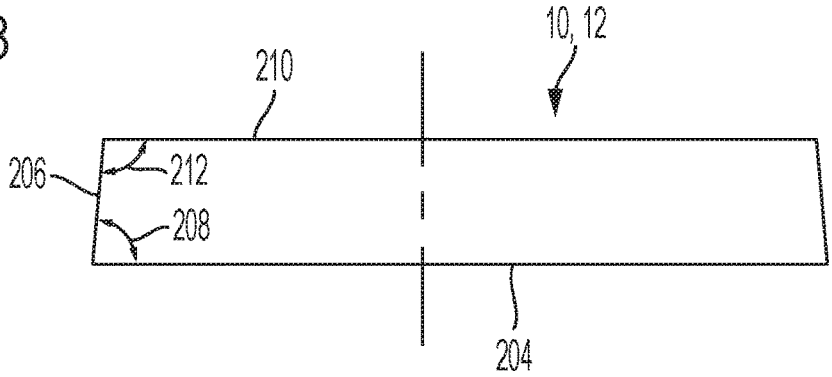
FIG. 29 is a side view of one tile shown in FIG. 28.

Referring now to FIGS. 28 and 29, a plurality of tiles 10, 12 is shown. The tile 10 may be secured to the wall by way of a magnet or other attachment mechanism 200 discussed herein. The adjacent tiles 12 may be secured to the anchor tile 10 by way of magnets 16 which may be embedded within or attached to the side panels of the tiles 10, 12. The anchor tile 10 may be flush mounted to the wall surface 28 in that the outer peripheral edges of the rear side of the tile 10 may contact the wall surface 28. Moreover, even if the wall surface 28 is not flat, the peripheral edges of the rear side of the tile 10 may contact the wall surface 28. By way of example and not limitation, the wall surface 28 may have a concave or convex configuration. The anchor tile 10 may sit flush to the surface 28 because the attachment mechanism 200 pulls the central portion of the anchor tile 10 against the wall surface 28. For a wall surface having a concave configuration, the peripheral edges 202 of the rear side of the tile 10 may contact the wall surface 28. For a surface having a convex configuration, the peripheral edges 202 of the rear side of the tile 10 may come close to but might not necessarily touch the wall surface depending on the degree of concavity. The peripheral edges 202 lay flush against the wall surface 28.

FIG. 29 is an enlarged view of the tile 10, 12 shown in FIG. 28. A front surface 204 and a side surface 206 may define an acute angle 208. By way of example and not limitation, the acute angle 208 may be between and including less than 90 degrees and 80 degrees, and is preferably between and including 89.5 degrees and 85 degrees. Preferably, the acute angle 208 is 88 degrees. A back surface 210 of the tile 10, 12 may define an obtuse angle 212 with respect to the side surface 206. By way of example and not limitation, the obtuse angle 212 may be between and including greater than 90 degrees and 100 degrees, and is preferably between and including 90.5 degrees and 95 degrees. Preferably, the obtuse angle 212 is 92 degrees. The preferred acute angle 208 of 88 degrees and preferred obtuse angle 92 degrees translate into an angled relief of 2 degrees.

Because of the acute and obtuse angles 208, 212, the adjacent tiles 12 may also lay flush to the wall surface 28 even when the wall surface 28 is concave or convex. As shown in FIG. 28, the front edges 214 of the tiles 10, 12 may be in contact with each other. Although the front edges 214 of the tiles 10, 12 are shown as touching, it is contemplated that a front edge portion of the tiles 10, 12 may touch each other. The magnets 16 at the side surfaces 206 of the tiles 10, 12 may be attracted to each other. The adjacent tiles 12 pivot about the front edges 214 or front edge portions due to the attractive forces caused by the magnet 16 so that the rear edges 202 of the adjacent tiles 12 on the opposite side of the front edges 214 push down against the wall surface 28. When the wall surface 28 is convex, then the angular gap 216 defined by the side surfaces 206 of adjacent tiles 10, 12 may be smaller than when the surface 28 is perfectly flat.

Conversely, when the surface 28 is concave, then the angular gap 216 defined by the side surfaces 206 of the adjacent tiles 10, 12 may be larger than when the surface 28 is perfectly flat to accommodate the concave configuration of the wall surface 28. In both scenarios, the rear edges 202 of the adjacent tiles 12 are pushed against the wall surface 28 due to the pivoting nature of the tiles 12 about the front edges 214/front edge portions and the attractive forces of the magnet 16 in adjacent side panels/surfaces. Even when additional tiles 12 are attached to the existing tiles 12, the rear edges 202 of adjacent tiles 12 are forced into the wall surface 28 regardless of the convex or concave configuration of the wall surface 28.

The magnets 16 at the side surfaces are positioned on the side surfaces at the same distance from the front and rear surfaces. When the magnets are attracted to each other, they mitigate the front edges or front edge portions of adjacent tiles 10, 12 from slipping off of each other. Rather, the magnets 16 at the side panels are aligned to each other.

A picture or printed image may be disposed on or at the front surface 210. In the discussion above, the image was printed on paper board and formed into a folding carton. However, other embodiments are also contemplated.

Figure 30:
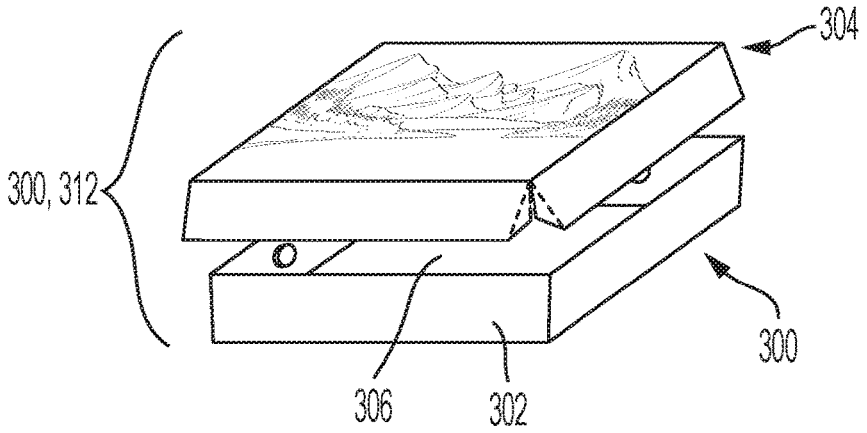
FIG. 30 is an exploded perspective view of another embodiment of the tile.
Figure 31:
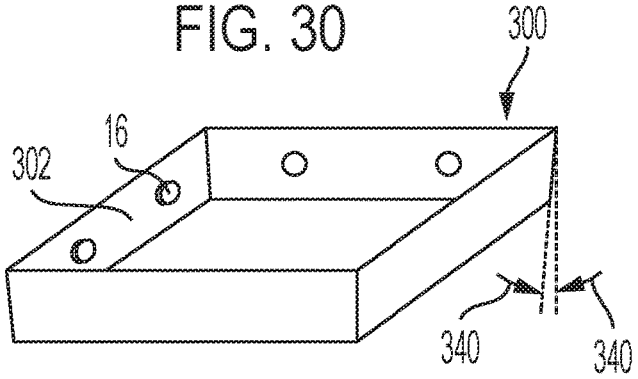
FIG. 31 is a perspective view of a base on the tile shown in FIG. 30.
Figure 32:
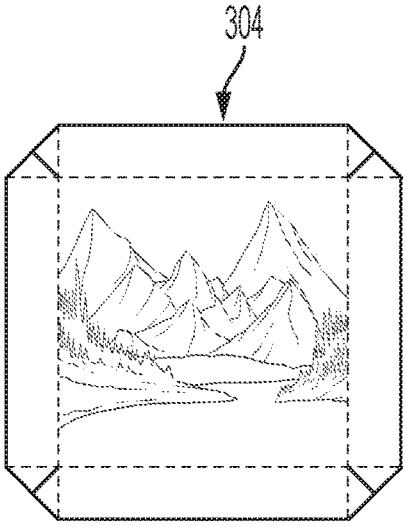
FIG. 32 is a top view of a print layer of the tile shown in FIG. 30.
Figure 33:
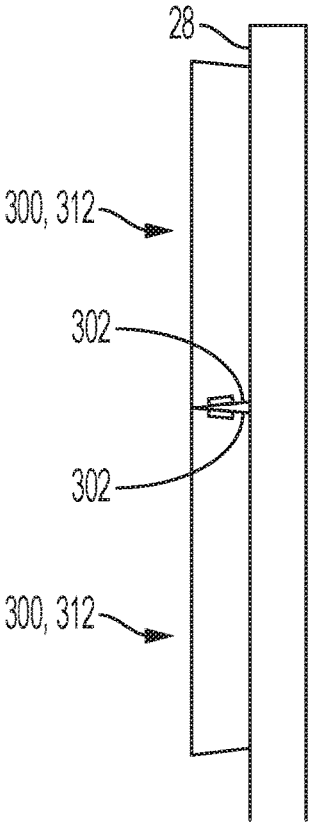
FIG. 33 is a side view of a plurality of tiles of the tile embodiment shown in FIG. 30.
Figure 34:
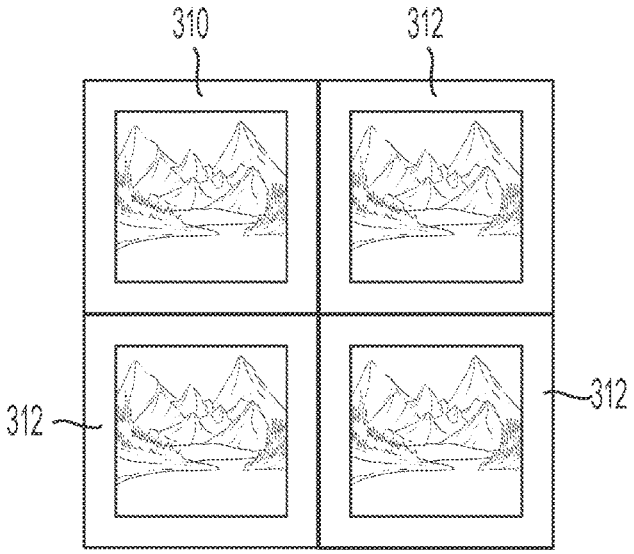
FIG. 34 is a front view of a plurality of tiles of another embodiment.
Figure 35:
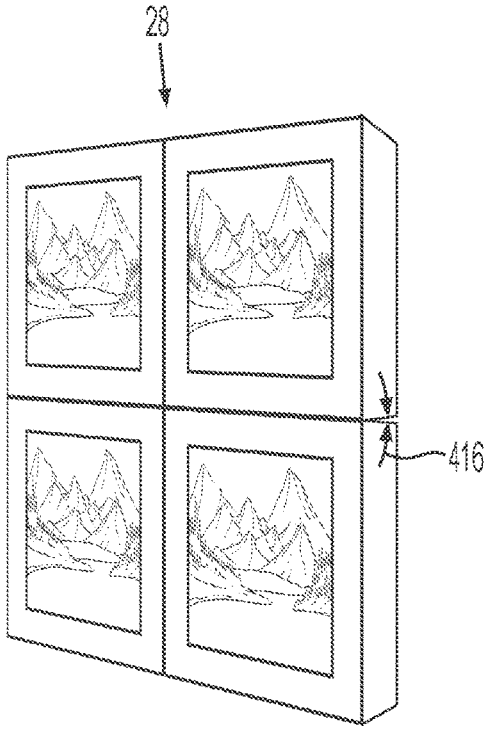
FIG. 35 is a perspective of the plurality of tiles shown in FIG. 34.

Referring now to FIGS. 31-33, a base 300 with magnets mounted to the side panels 302 is shown. The base 300 may be a plastic injection molding part, paper box, a wooden box or a metal box. A print layer 304 may be mounted to the base 300, as shown in FIG. 30. The print layer 304 may be a paper or other sheet which the image is printed thereon. The side panel 302 of the base 300 may be angled to the rear panel 306 as described in relation to the FIGS. 28 and 29. In this regard, the tiles 310, 312 shown in FIGS. 30-33 may operate to be flush mounted to the wall surface 28 in the same manner described above in relation to tiles 10, 12. As shown in FIG. 33, the side surfaces 302 may have an angled relief 340 which collectively forms the angular gap 216 so that regardless of the unevenness (i.e., concave or convex) of the wall surface, the rear edges of the tiles 310, 312 touch the wall surface so that the tiles 310, 312 lay flush against the wall surface.

Figure 36:
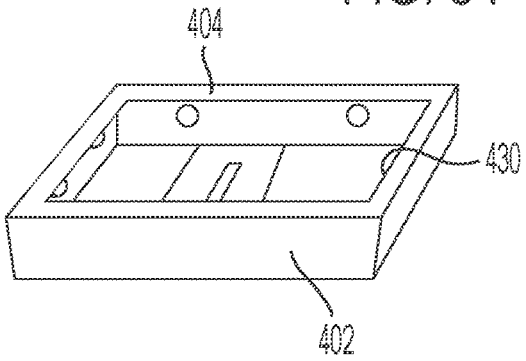
FIG. 36 is a front perspective view of one tile of the plurality of tiles shown in FIGS. 34 and 35.
Figure 37:
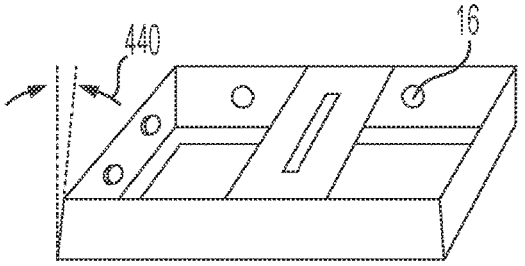
FIG. 37 is a rear perspective view of the tile shown in FIG. 36.

Referring now to FIGS. 34-37, the tiles 410, 412 are shown. In this regard, the tiles 10*c*, 12*c* may be a picture frame as shown in FIG. 36. The picture frame may be fabricated from a paper material, plastic material, wooden material, or metal material. The picture may be printed on a paper and inserted into or attached to the front surface 404. In FIG. 36, the picture may be aligned to the aperture 430. The picture frame 10*c*, 12*c* may also have side panels 402 that define an angular gap 416. The tiles 410, 412 may be attached to the wall as described above as well as attached to each other with magnets 16. The tiles 410, 412 may operate in the same manner described above to ensure that the adjacent tiles 412 lie flush against the wall surface 28. The side surfaces 402 may have an angled relief 440 that form the angular gap 416 so that the tiles 410, 412 lay flush against the wall surface 28 even when the wall surface is uneven due to it being concave or convex.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A plurality of paperboard folding cartons flush mounted to a flat surface of a wall, the plurality of paperboard folding cartons comprising:

a first folding carton having:

a front panel defining a length and width, rear panel defining a length and width, left side panel defining a length and height, a right-side panel defining a length and height, a top panel defining a height and a bottom panel defining a height;

wherein the length of the rear panel is less than a length of the front panel, the width of the rear panel is less than a width of the front panel and a height of the left side panel is equal to a height of the right side panel and the rear panel is centrally disposed behind the front panel so that straight lines extending through first, second, third and fourth corners of the front panel through respective ones of the first, second, third and fourth corners of the rear panels are inwardly skewed in a direction from the first through fourth corners of the front panel to the first through fourth corners of the rear panel;

a first magnet disposed on the rear panel;

a second magnet disposed on one or more of the left side panel, right side panel, top panel and bottom panel;

a second folding carton having:

a front panel defining a length and width, rear panel defining a length and width, left side panel defining a length and height, a right-side panel defining a length and height, a top panel defining a height and a bottom panel defining a height;

wherein the length of the rear panel is less than a length of the front panel, the width of the rear panel is less than a width of the front panel and a height of the left side panel is equal to a height of the right side panel and the rear panel is centrally disposed behind the front panel so that straight lines extending through first, second, third and fourth corners of the front panel through respective ones of the first, second, third and fourth corners of the rear panels are inwardly skewed in a direction from the first through fourth corners of the front panel to the first through fourth corners of the rear panel;

a third magnet disposed on one or more of the left side panel, right side panel, top panel and bottom panel wherein the third magnet is magnetically attached to the second magnet for attaching the first and second folding cartons together;

wherein the inward skewing of the straight lines of the first and second folding cartons forms reliefs of the first and second folding cartons so that the folding cartons lay flat on the flat surface of the wall.

2. The folding carton of claim 1 wherein the image is printed on one or more of the top panel, bottom panel, left-side panel and right-side panel.

3. The folding carton of claim 1 wherein a skew angle of the straight lines is from 0.5 degrees to 20 degrees.

4. The folding carton of claim 1 wherein all of the panels are fabricated from a paper material.

5. The folding carton of claim 4 wherein a thickness of the panels is from 0.012 inches to 0.020 inches.

6. The folding carton of claim 1 wherein the relief defines an angle and the angle of the relief is sufficiently large to accommodate deformations in the side, top and bottom panels.

7. An image displaying system for flush mounting a plurality of images on a vertical wall, the system comprising:

a plurality of bodies, each body defining:

a front portion having a plurality of peripheral edges that define a front surface, an image displayed on the front surface;

a rear portion having a plurality of peripheral edges, a peripheral edge of the front portion being aligned to a peripheral edge of the rear portion, the rear portion being attachable to the vertical wall;

a plurality of side portions, each side portion defining a side surface, a side surface of the side portion being aligned to corresponding aligned peripheral edges of the front and rear portions;

wherein the peripheral edges of the rear portion are offset toward a center of a surface area defined by the plurality of peripheral edges of the rear portion, and the surface area defined by the plurality of peripheral edges of the rear portion is less than a surface area defined by the plurality of peripheral edges of the front portion;

a plurality of magnets attached to the side portions of the plurality of bodies at a same distance between the corresponding aligned peripheral edges of the front and rear portions;

wherein magnetic attractive forces attached to side portions of adjacent bodies attract adjacent bodies to each other and the corresponding peripheral edges of the front portion of adjacent bodies contact each other so that when the adjacent bodies are attached to vertical wall that has a convex or concave mounting surface, the adjacent bodies pivot about the corresponding peripheral edges so that the peripheral edges of the rear portion of the adjacent bodies are urged toward the mounting surface of the vertical wall;

wherein for each body, the side surface is angled inward in a direction from the front portion to the rear portion, and an area of the side surface closer to the front portion is offset outward compared to an area of the side surface closer to the rear portion.

8. The system of claim 7 wherein for each body, the body comprises a plastic injection molded base and a sheet having the image printed thereon, the sheet being attached to a front portion of the plastic injection molded base.

9. The system of claim 7 wherein for each body, the body comprises a folding carton fabricated from paper, plastic or combinations thereof.

10. The system of claim 7 wherein for each body, the plurality of edges of the front portion define a polygonal shape.

11. The system of claim 7 wherein for each body, a center of the surface area defined by the plurality of peripheral edges of the rear portion and a center of the surface area defined by the plurality of peripheral edges of the front portion both intersects a first axis perpendicular to the front surface.

12. The system of claim 7 wherein for each body, the peripheral edges of the front portion are in first flat plane, and the peripheral edges of the rear portion are in a second flat plane, the first and second flat planes being parallel to each other.

13. The system of claim 7 wherein for each body, the side surface is angled inward in a direction from the front portion to the rear portion.

14. The system of claim 13 wherein for each body, the inward angle of the side surface is greater than 1 degree and less than 45 degrees.

15. An image displaying system for flush mounting a plurality of images on a vertical wall, the system comprising:

a plurality of bodies, each body defining:

a front portion having a plurality of peripheral edges that define a front surface, an image displayed on the front surface;

a rear portion having a plurality of peripheral edges, a peripheral edge of the front portion being aligned to a peripheral edge of the rear portion, the rear portion being attachable to the vertical wall;

a plurality of side portions, each side portion defining a side surface, a side surface of the side portion being aligned to corresponding aligned peripheral edges of the front and rear portions;

wherein the peripheral edges of the rear portion are offset toward a center of a surface area defined by the plurality of peripheral edges of the rear portion, and the surface area defined by the plurality of peripheral edges of the rear portion is less than a surface area defined by the plurality of peripheral edges of the front portion;

a plurality of magnets attached to the side portions of the plurality of bodies at a same distance between the corresponding aligned peripheral edges of the front and rear portions;

wherein magnetic attractive forces attached to side portions of adjacent bodies attract adjacent bodies to each other and the corresponding peripheral edges of the front portion of adjacent bodies contact each other so that when the adjacent bodies are attached to vertical wall that has a convex or concave mounting surface, the adjacent bodies pivot about the corresponding peripheral edges so that the peripheral edges of the rear portion of the adjacent bodies are urged toward the mounting surface of the vertical wall;

wherein for each body, the side surface is angled inward in a direction from the front portion to the rear portion, and the side surfaces has a flat configuration between the corresponding peripheral edges of the front and rear portions.

* * * * *